US011318341B2

(12) United States Patent
Marti

(10) Patent No.: US 11,318,341 B2
(45) Date of Patent: May 3, 2022

(54) PORTABLE LOWER LIMB THERAPY DEVICE

(71) Applicant: Eduardo M. Marti, Weston, FL (US)

(72) Inventor: Eduardo M. Marti, Weston, FL (US)

( * ) Notice: Subject to any disclaimer, the term of this patent is extended or adjusted under 35 U.S.C. 154(b) by 24 days.

(21) Appl. No.: 17/126,423

(22) Filed: Dec. 18, 2020

(65) Prior Publication Data

US 2021/0101043 A1 Apr. 8, 2021

Related U.S. Application Data

(63) Continuation-in-part of application No. PCT/US2019/050950, filed on Sep. 13, 2019, and a (Continued)

(51) Int. Cl.

*A63B 21/00* (2006.01)
*A63B 21/04* (2006.01)
*A63B 23/04* (2006.01)

(52) U.S. Cl.

CPC .. *A63B 21/00178* (2013.01); *A63B 21/00185* (2013.01); *A63B 21/0407* (2013.01); *A63B 21/152* (2013.01); *A63B 21/4034* (2015.10); *A63B 21/4035* (2015.10); *A63B 23/0417* (2013.01)

(58) Field of Classification Search

CPC ..... A63B 21/00178; A63B 21/00185; A63B 21/0407; A63B 21/152; A63B 21/4034; A63B 21/4035; A63B 23/0417; A63B 21/0442; A63B 21/0552; A63B 21/151; A63B 21/4025; A63B 2022/0094; A63B 2208/0252; A63B 21/4015; A63B 22/20; A63B 21/0557; A63B 23/03508; A63B 2023/006; A63B 21/4011; A63B 21/00181; A61H 1/0237; A61H 1/0259; A61H 1/0266; A61H 1/024; A61H 2201/0157; A61H 2201/0153; A61H 2203/0456; A61H 2203/045; A61H 2205/102; A61H 2201/1664; A61H 2205/106; A61H 2201/1671; A61H 2205/10;

(Continued)

(56) References Cited

U.S. PATENT DOCUMENTS 296,420 A * 4/1884 Maloney ..... H04R 11/00 381/417
3,713,437 A * 1/1973 Wiedmer ..... A61F 5/0116 602/28

(Continued)

*Primary Examiner* — Garrett K Atkinson
(74) *Attorney, Agent, or Firm* — The Keys Law Firm PLLC

(57) ABSTRACT

A portable lower limb therapy device having a support base and a force transfer system. The support base includes an exterior surface suitable to slide on smooth surfaces and an interior surface suitable to receive and conform to a foot of a user. The force transfer system embodied through one or two cords integrated with the support base and operates to transfer force applied behind and above the foot of a user that is in the support base to the support base. The portable lower limb therapy device may be used with a wearable anchor that is attachable to the thigh of the user of allows for the cord or cords to be fixed in place for the performance of static progressive stretch therapy motions without requiring ongoing manual force.

20 Claims, 18 Drawing Sheets

Related U.S. Application Data continuation-in-part of application No. 16/445,960, filed on Jun. 19, 2019, now abandoned, and a continuation-in-part of application No. 16/183,670, filed on Nov. 7, 2018, now Pat. No. 10,926,124, and a continuation-in-part of application No. 16/130,953, filed on Sep. 13, 2018, now Pat. No. 10,981,035.

(58) Field of Classification Search
CPC .... A61H 2201/1642; A61H 2201/1276; A61H 2201/1635
See application file for complete search history.

(56) References Cited

U.S. PATENT DOCUMENTS 5,277,680 A * 1/1994 Johnston ..... A63B 21/154 482/125
5,762,592 A * 6/1998 Neveux ..... A63B 21/4015 482/131
5,832,560 A * 11/1998 DePalma ..... B60B 33/066 36/110
5,853,354 A * 12/1998 Kubota ..... A63B 21/4025 482/80
6,425,844 B1 * 7/2002 Azar ..... A61H 1/0259 482/79
6,551,221 B1 * 4/2003 Marco ..... A63B 69/0059 280/600
7,740,566 B2 * 6/2010 Nativ ..... A63B 21/00181 482/68
8,864,632 B2 * 10/2014 Johnson ..... A63B 21/0442 482/79
9,446,288 B1 * 9/2016 Pazan ..... A63B 23/03508
9,821,184 B1 * 11/2017 Chapman ..... A61H 1/024
10,232,213 B1 * 3/2019 Smith, Jr. ..... A63B 21/0442
10,576,620 B1 * 3/2020 Chou ..... A61F 2/72
2006/0040807 A1 * 2/2006 Miller ..... A63B 69/0022 482/124
2008/0119765 A1 * 5/2008 Meckel ..... A61H 1/024 601/5
2009/0107533 A1 * 4/2009 Nativ ..... A61H 3/04 482/124
2012/0040808 A1 * 2/2012 Khademi ..... A61H 1/0277 482/124
2013/0090218 A1 * 4/2013 Johnson ..... A63B 21/0552 482/124
2014/0180179 A1 6/2014 Cunningham et al.
2015/0190668 A1 * 7/2015 Ferdinandsen, II ..... A63B 21/4035 482/93
2015/0343261 A1 * 12/2015 Liptack ..... A63B 23/0494 482/80
2018/0290002 A1 * 10/2018 Colangelo ..... A63B 21/00043
2018/0296420 A1 * 10/2018 Andrews ..... A61H 15/00
2018/0318639 A1 * 11/2018 Kim ..... A63B 21/023
2020/0197743 A1 * 6/2020 Biele ..... A63B 21/4007
2020/0261758 A1 * 8/2020 Souffrain ..... A63B 21/4017

* cited by examiner

PORTABLE LOWER LIMB THERAPY DEVICE

CROSS REFERENCE TO RELATED APPLICATIONS

This application is a continuation in part of, claims the benefit of, and incorporates by reference co-pending U.S. patent application Ser. No. 16/130,953 filed Sep. 13, 2018, co-pending U.S. patent application Ser. No. 16/183,670 filed Nov. 7, 2018, co-pending U.S. patent application Ser. No. 16/445,960 filed Jun. 19, 2019, and co-pending PCT patent application serial number PCT/US19/50950 filed Sep. 13, 2019.

BACKGROUND OF THE INVENTION

Field of the Invention

This invention relates to a portable therapy device and an anchor for use with such a portable therapy device, which, when used by a user on a lower limb, allow the user to perform rehabilitative activities on the lower limb while controlling the speed and direction of active and passive forces across a multitude of planes while doing so, and further to be able to fix the device in a desired position relative to the user without requiring that application of ongoing force from the user.

Description of the Prior Art

Following acute lower limb injuries and/or surgery, it is common for patients to suffer from mechanical limitations in and around their joints. In order to help a patient regain strength and range of motion ("ROM") to the affected joints, patients are generally required to participate some form of therapy during the recovery process. Such therapy may involve attending clinician (e.g., physician, physical therapist) directed sessions at a clinic or medical facility. Unfortunately, often times therapy sessions are cut short prior to the completion of the recovery process. This can be due to a variety of reasons, such as limited treatment sessions approved by insurance companies, lack of transportation, inclement weather, illness, or inability to take days off from work to attend therapy sessions at the clinic.

In instances wherein therapy sessions are cut short, at-home adjunct devices may be used by a patient at home to optimize rehabilitation outcomes and to avoid scar tissue formation in order to eliminate the need for extended rehabilitation at a physical therapy ("PT") clinic or for manipulation under anesthesia ("MUA"). Indeed, it is well established that clinicians often prescribe the use of various rehabilitation (or rehab) devices to the injured patient to allow a patient to continue work to restore their health without having to attend frequent in-clinic therapy sessions. This practice has led to the development of many different types of devices designed to help augment rehabilitation efforts and patients that wish to continue to progress without the benefit of an in-clinic professional therapist, use these types of devices.

Adjunct at-home devices available today for knee and hip therapy cover a broad spectrum of options. Nonetheless, there are two types of motions that are viable, and typically, these devices generally only cover one or the other type of motion. The first type, passive motion, is a motion created by an outside force action on the persons limb/joint. The second type, active motion, is a motion in which the patient is supplying the force to move the affected limb on their own. In instances wherein a patient is working in-clinic with a clinician, the clinician typically provides both types of motions when they provide therapy to a patient. For example, the clinician can hold a patient's limb at a desired flexed position, and then asked the patient to activate their muscles to try to move their limb while the therapist resists (active resistance). A clinician may also slowly allow the patient to move the limb as the clinician adjusts the tension, allowing movement to occur (isotonic). A clinician may also allow the patient to move the limb by pushing as hard as they can while providing sufficient resistance to allow movement to occur at a set speed (isokinetic). A clinician may also have the patient push as hard as they can for 10 seconds then release the resistance and allow the patient to move to a different angle and repeat the same 10 second routine (isometric). A clinician can also have the patient try to lightly resist the motion the clinician provides as the clinician moves the limb through a range of motion (eccentric). In any event, the clinician is trained to evaluate the dynamics of movement that each patient exhibits and perform the best or combination of the best motion therapies that can improve joint function.

Attempts have been made to provide adjunct at-home devices which meet the needs of patients. Many of the devices for home use for ankles and knees are portable cycling devices. These devices have stands with foot pedals. The patient simply mimics riding a bicycle while sitting on a chair. Some of devices are motorized so that the patient can just relax and let the device rotate and move the limb. This type would be considered passive. The same bicycle type may have a resistance capability whereby a frictional force can make the patient provide more muscle power to turn the pedals, providing active resistance. This is also a type of isotonic motion.

Another class of devices is passive type equipment. Devices used after knee arthroscopic or knee implant surgery are known as continuous passive motion ("CPM") devices. These devices have electronic controllers that can be programmed to move the limb through a set ROM at a set speed and with a defined force level. These devices are rented by the day are generally utilized for about 14-21 days. Unfortunately, many insurance companies will not pay for a CPM device.

There are a several devices that provide a track with a sliding platform that allow the patient to flex and extend the leg using the track as a guided path and then by turning the track sideways, do hip abduction exercises. This type of device offers little or no resistance and its primary function is to keep joint mobility or maintain ROM between therapy sessions. The slider type device requires the patient to supply the energy to move the limb. This would be considered a low force active exerciser.

Other types of devices are the standard fitness-gym devices (e.g. leg extension machines) that use weights to provide resistance to the patient's limbs. These types of devices are external devices that are not used to rehabilitate the patients injured knee joint at home and they do not provide a feedback loop to the patient.

Another type of activity which may be employed during a recovery process is stretching. In many cases, clinicians may direct the utilization of mechanical stretching devices as part of a stretching program. Generally, mechanical stretching devices may be categorized as either dynamic low-load prolonged duration stretch devices ("LLPS") or static progressive ("SP") (i.e., splint) stretch devices. LLPS devices permit resisted active and passive motion (elastic traction) within a limited range. SP stretch devices hold the joint in a set position but allow for manual modification of the joint angle (inelastic traction).

In light of the normal therapy protocols that are implemented by a clinician, there remains a need for an adjunct at-home therapy device that is able to facilitate the performance of rehabilitation exercises similar to those used by a clinician as they pertain to combined types of motions, active and passive, as well as those motions described as active resistive (isotonic), and active/rest/passive (contract relax therapy). There also remains a need for an adjunct at-home therapy device that can provide for both dynamic and static progressive stretch therapy. And to enhance the capability of such an adjunct at-home therapy device, there is a need for an anchor device which allows for such an adjunct at-home device to be selectively fixed in a desired location relative to a user's body so as to enable the performance of a wider variety of motions, such as progressive stretching type motions, without forcing the user to have to hold the adjunct at-home device in place during the motion(s).

SUMMARY OF THE INVENTION

The present disclosure provides for a portable lower limb therapy device, comprising: a support base having an exterior surface and an interior surface, wherein the interior surface is configured to receive a foot of a user and the exterior surface includes at least one smooth surface which enables the support base to slide on a discrete surface that is also smooth; wherein the support base includes a proximal edge and a distal edge; a closed force transfer system integral with the support base, wherein the closed force transfer system includes at least one connector member having a back end and at least one discrete cord member having a front end and an opposing handle end; wherein the at least one connector member is integral with the support base at both a location adjacent to the proximal edge and a location adjacent to the distal edge, with the back end positioned closer to the location adjacent to the distal edge; wherein the front end of the at least one discrete cord member is selectively coupled with the back end of the at least one connector member; and wherein the closed force transfer system is operative to allow force exerted through the at least one discrete cord member to be transferred to the support base.

Embodiments of the portable lower limb therapy device may have a closed force transfer system that includes a single cord or multiple cords, include substantially static cords or a mix of substantially static cords and dynamic bands, and further may have cord(s) which extend from the distal end of the support base or from the proximal end of the support base.

Embodiments of the portable lower limb therapy device may be used with a wearable anchor configured to be secured to a body of a user and having at least one support member and at least one locking component, wherein said at least one support member includes a top surface and a bottom surface and is configured to be placed against the body of the user with the bottom surface contacting the body of the user; and wherein said locking component is configured to receive and selectively secure the at least one discrete cord member.

DETAILED DESCRIPTION OF THE INVENTION

Figure 1:
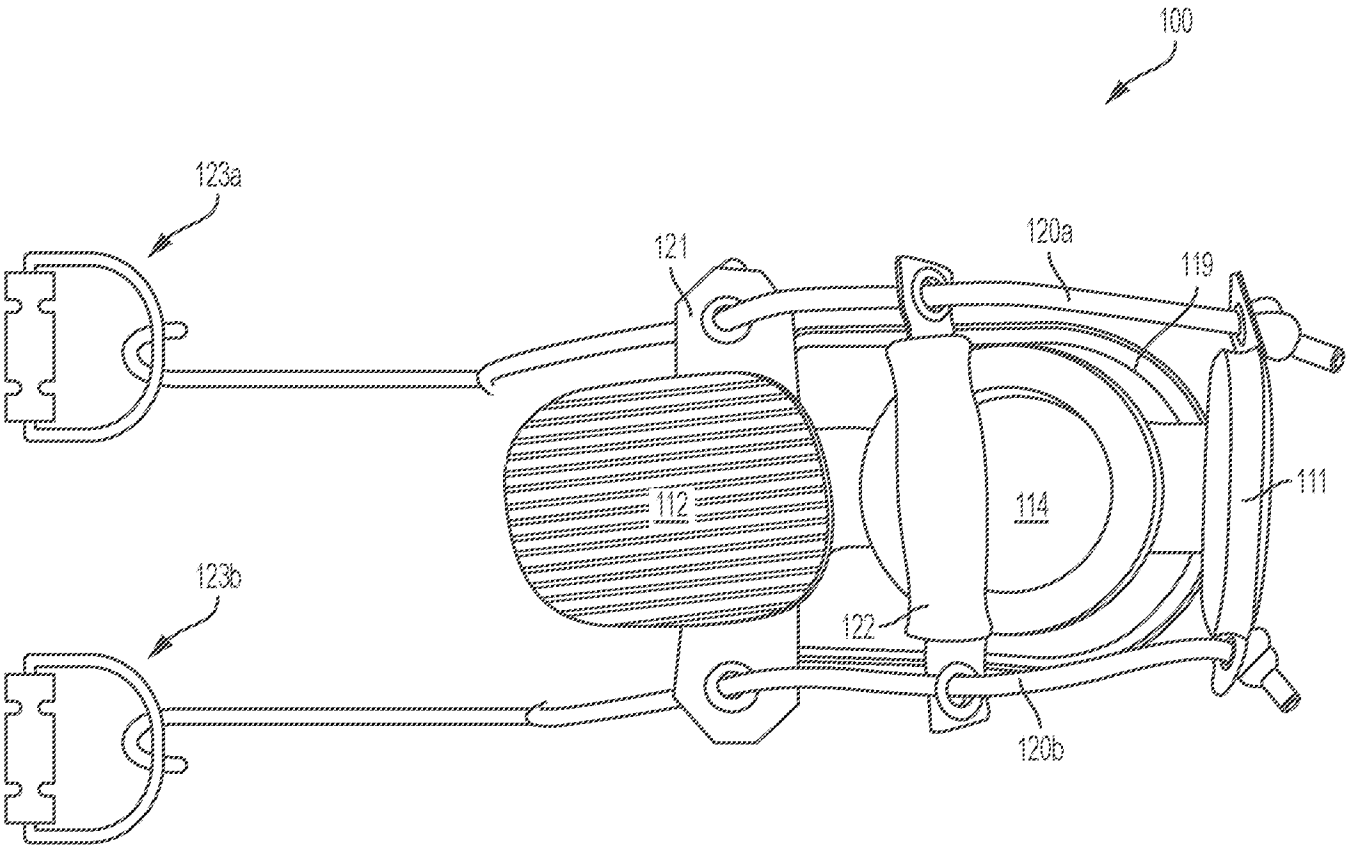
FIG. 1 is a top plan view of a portable lower limb therapy device built in accordance with a front handle embodiment of the present invention.
Figure 2:
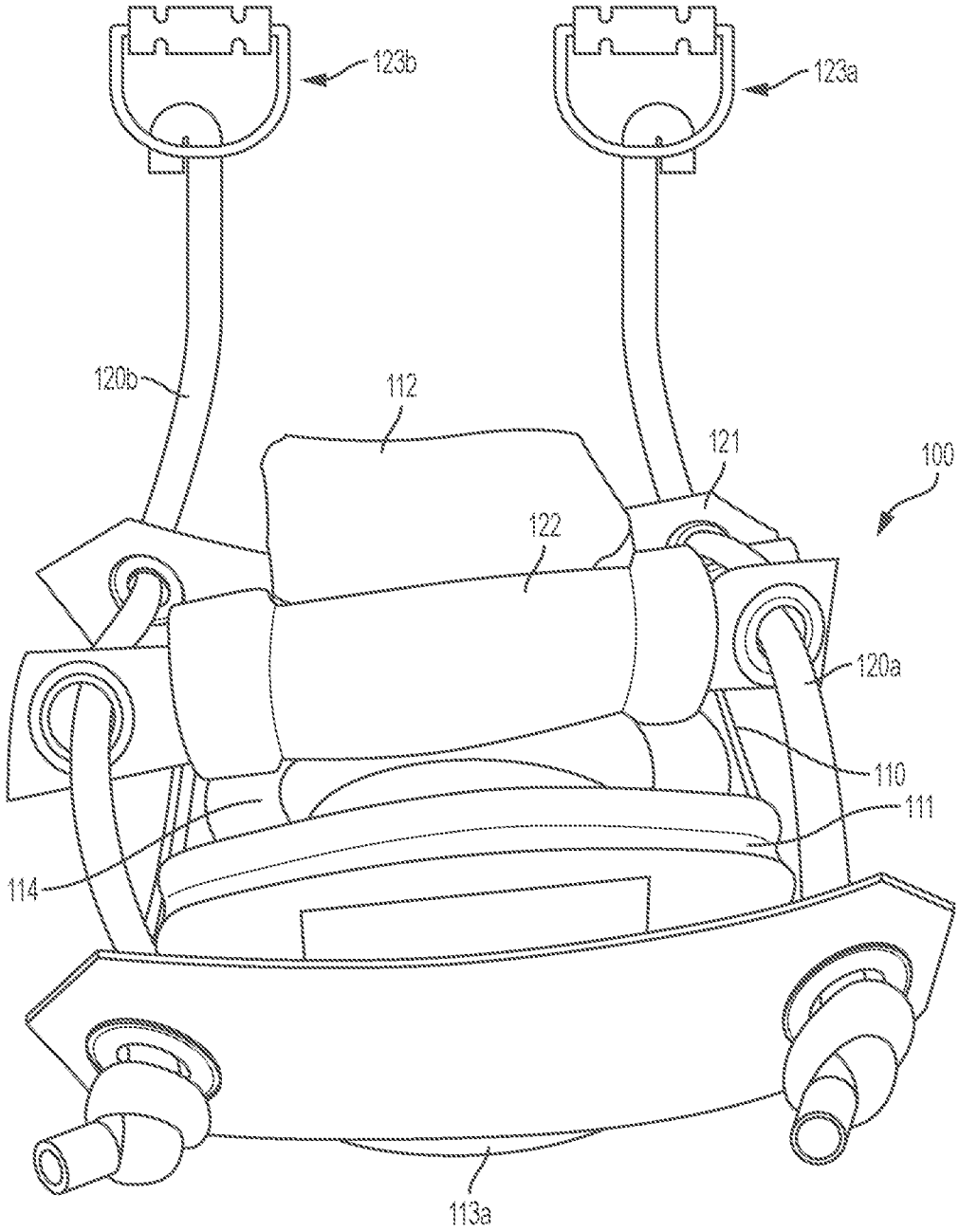
FIG. 2 is a rear perspective view of a portable lower limb therapy device built in accordance with a front handle embodiment of the present invention.

Described herein are embodiments of a portable lower limb therapy device, and embodiments of a wearable anchor which can be used in conjunction therewith. Embodiments of the portable lower limb therapy device can be used to allow the user to perform rehabilitative activities on the lower limb while controlling the speed and direction of active and passive forces across a multitude of planes while doing so. Embodiments of the wearable anchor can be used to mechanically fix aspects of the portable lower limb therapy device in a desired position relative to the user so as to enable the performance of static progressive stretch therapy motions without requiring the application of ongoing force from the user (or another person).

Referring now to the drawings and, in particular, FIGS. 1, 2, 3, and 4 a portable lower limb therapy device 100 built in accordance with a front handle embodiment is shown having a support base and a pulley system. The support base includes a slider 110 having a platform member 112 fixably mounted on top of it and a back panel 111 extending up from it. The support base has a proximal edge 113*a* and a distal edge 113*b*, which may be formed as the rear and front edges of the slider 110, respectively and the back panel 111 is positioned to extend up from the support base at a location at or behind the proximal edge 113*a*. The support base may additionally include a foot pad 114 positioned over the top of the slider 110 and adjacent to the proximal edge 113*a*.

The slider 110 may define a rigid, slightly curved member having a smooth bottom surface that limits friction and allows it slide and glide when placed on other surfaces. The slider 110 may be constructed of hard plastic.

Figure 3:
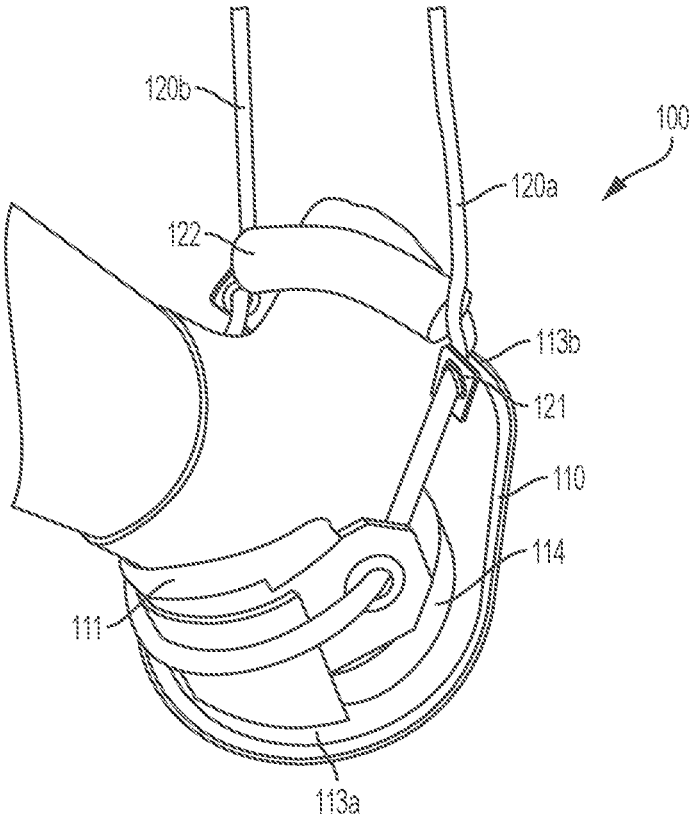
FIG. 3 is a rear perspective view of a portable lower limb therapy device built in accordance with a front handle embodiment of the present invention, shown with a patient's foot in placed therein.
Figure 4:
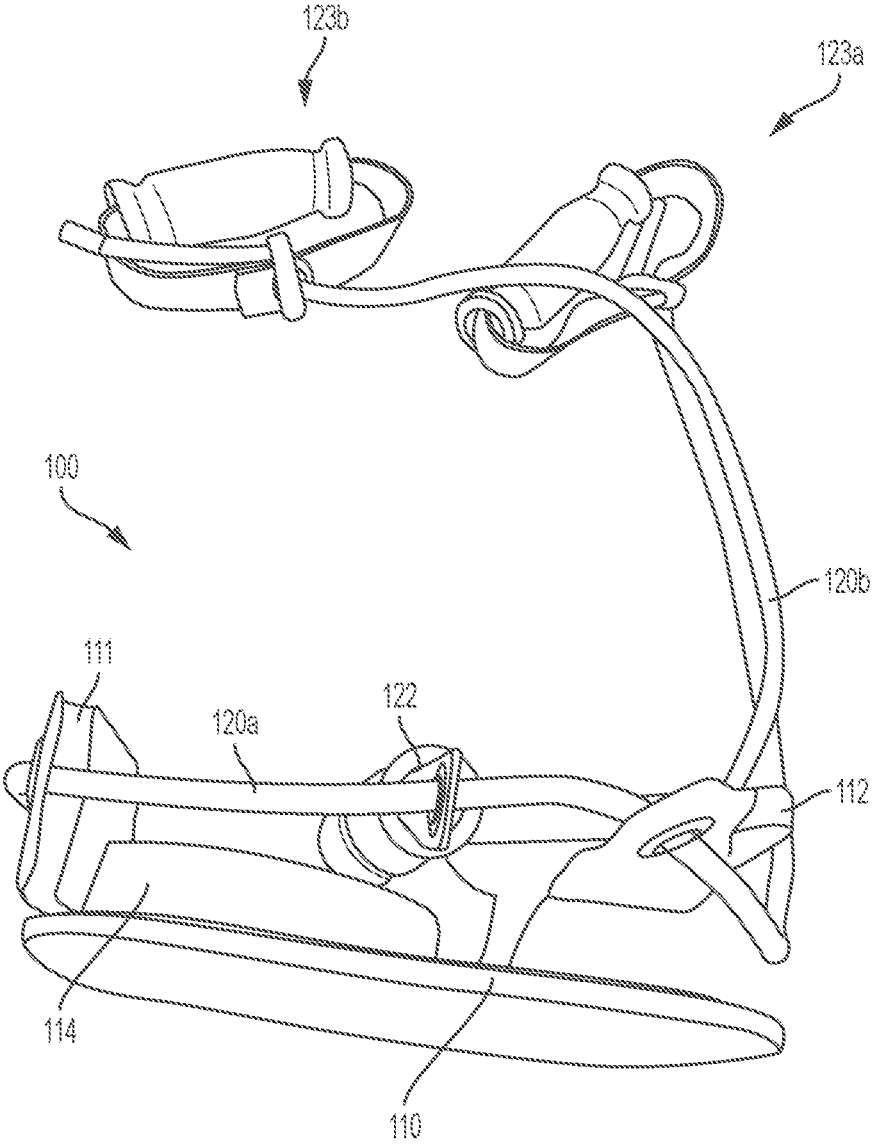
FIG. 4 is a side perspective view of a portable lower limb therapy device built in accordance with a front handle embodiment of the present invention.

The platform member 112 may be defined by an elongated planar pad and is positioned adjacent to the distal edge 113*b* and may extend beyond the distal edge 113*b*. The platform member 112 may be positioned and oriented in an elevated position enables the placement of a foot of a user in a therapeutic diagonal position relative to the slider 110, with the heel of the foot resting in the foot pad 114 and the foot extending up therefrom onto a substantially diagonally oriented platform member 112, as illustrated in FIG. 3.

The back panel 111 may be defined as a planar or slightly curved pad and may be attached to and extend up from the slider 110. The foot pad 114 may be defined as a circular padded body having a raised perimeter edge and a depressed center portion. It is appreciated that the foot pad 114 configures the support base to be able to receive a heel of a user's foot and allow the heel to rest therein with the foot pointing towards the distal edge 113*b*. The back panel 111, platform member 112, and foot pad 114 may be constructed out of a substantially firm yet pliable foam material, and may be coupled together by a connector that is above the slider 110 and runs from the back panel 111 to the platform member 112.

In an alternate embodiment, the platform member 112 and foot pad 114 may be formed as a unitary body. In such an embodiment, the platform member 112 may be movable relative to the slider 110 so as to be able to flex between an elevated position relative to the slider 110 and a planar position relative to the slider 110. It is appreciated that the platform member 112 being in the elevated position, forming a slope that rises as it moves away from the proximal edge 113*a*, defines the flexed configuration of the support base while the platform member 112 being in the planar position, sitting in horizontal alignment with the platform member 112, defines the relaxed configuration of the support base.

The pulley system defines a closed force transfer system and includes two cord members 120*a* 120*b*, a support member 121, a cross member 122, and two handles 123*a*, 123*b*, with a right handle 123*a* adjacent to the right side of the portable lower limb therapy device 100 and a left right handle 123*a* adjacent to the left side thereof. A right cord member 120*a* connects to and extends from the back panel 111 on the right side and a left cord member 120*b* connects to and extends from the back panel 111 on the left side. The right cord member 120*a* then passes through an aperture positioned on the right side of the cross member 122, then through an aperture positioned on the right side of the support member 121, finally connecting to the right handle 123*a*. The left cord member 120*b* then passes through an aperture positioned on the left side of the cross member 122, then through an aperture positioned on the left side of the support member 121, finally connecting to the left handle 123*b*. In this regard, the back panel 111, cross member 122, and support member 121 each operate to connect the two cord members 120*a*, 120*b* and allows force that is applied to each of the handles 123*a*, 123*b* to act together to raise, lower, or otherwise manipulate the support base solely through the application of force on the handles 123*a*, 123*b*.

The handles 123*a*, 123*b* may be constructed of or otherwise include foam. The handles 123*a*, 123*b* may be defined by a substantially cylindrical handle portion with a foam surface and a web type strap, with the web type strap connecting to the cord members 120*a*, 120*b* and to the handle portion to improve durability without sacrificing comfort.

The support member 121 defines a mechanical connector integrated with the platform member 112, with a connection portion positioned on the right side of platform member 112 and a connection portion positioned on the left side of the platform member 112. Each connection portion may include an aperture therein so as to configure it to allow the cord members 120*a*, 120*b* to pass through it.

The support member 121 may define a molded or web type strap that is attached to the underneath of the platform member 112, above the slider 110, with a portion extending beyond the platform member 112 on both the right and left side so as to form the connection portions. The connection portions may include grommets integrated with the apertures therein. In an alternate embodiment, the support member 121 may be defined solely by two connection portions extending from either side of the platform member 112.

The cross member 122 is positioned sufficiently above the foot pad 114 to allow the foot of a user that is placed on the platform member 112 with the heel in the foot pad 114 to slide underneath the cross member 122. The cross member 122 may be defined by a substantially cylindrical handle portion with a foam surface.

Each cord member 120*a*, 120*b* may define an elongated, continuous line that may be constructed of a rope, strap, tubing, or cable. The cord members 120*a*, 120*b* may be of an elastic material or a rigid material.

The back panel 111 may include grommets integral with the apertures through which the cord members 120*a*, 120*b* pass prior to be secured thereto.

It is contemplated that a user having their foot positioned in the portable lower limb therapy device 100 may exert mechanical force on the lower limb therapy device 100 with their upper body (as passive motion) by grabbing either the handles 123*a*, 123*b* or the cross member 122. In this regard, the lower limb therapy device 100 enables pulling, pushing and lifting actions. When using passive motion with this device, the upper body limbs provide 100% of the energy. The energy requirements to raise and lower the lower limb can be selectively distributed in real time by a user through by using both the upper and lower limbs (at various levels of force). This feature provides the opportunity to scale up from 0% to 100% of the lower limb's force requirement limb to perform hip and knee flexion and extension, hip abduction and hip circumduction (as the lower limb therapy device 100 is not on a track and can move in any direction, circumduction an available therapy motion option). Indeed, the pulley system enables a user to control the motion and the speed at which the lower limb moves as it is being flexed and extended thru various planes.

Moreover, because of the slider 110 can move on substantially any type of smooth surface, the lower limb therapy device 100 provides a means to support the weight of a user's lower limb and allow the limb to slide and glide even on uneven surfaces as a bed or therapy table.

Referring now to FIGS. 5, 6, 7, 8, 9, and 10, a portable lower limb therapy device 200 built in accordance with a back handle embodiment is shown having a support base and a pulley system. The support base includes a slider 210 having a platform pad 212 fixably mounted on top of it and a back panel 211 positioned behind the platform pad 212, elevated above the platform pad 212. The platform pad 212 may include a distal portion 213. The back panel 211 may be attached to the slider 210 so as to extend out and up from the rear end of the slider 210. The pulley system includes a cord member 220, a support member 221, a cross member 222, and two handles 223, with one of the handles adjacent to the right side of the portable lower limb therapy device 200 and the other adjacent to the left side thereof.

The slider 210 may define a rigid, slightly curved member having a smooth bottom surface that limits friction and allows it slide and glide when placed on other surfaces. The platform pad 212 may define a planar member and may be attached to the slider 210 so as to be raised above the top surface of the slider 210, leaving a substantially hollow space between the bottom surface of the platform pad 212 and top surface of the slider 210. The platform pad 212 may additionally include a central aperture. It is appreciated that the central aperture in the platform pad 212, and the hollow space between the bottom surface of the platform pad 212 and top surface of the slider 210, configure the platform pad 212 to be able to receive a heel of a user's foot and allow the heel to rest therein with the foot pointing towards the distal portion 213.

Figure 5:
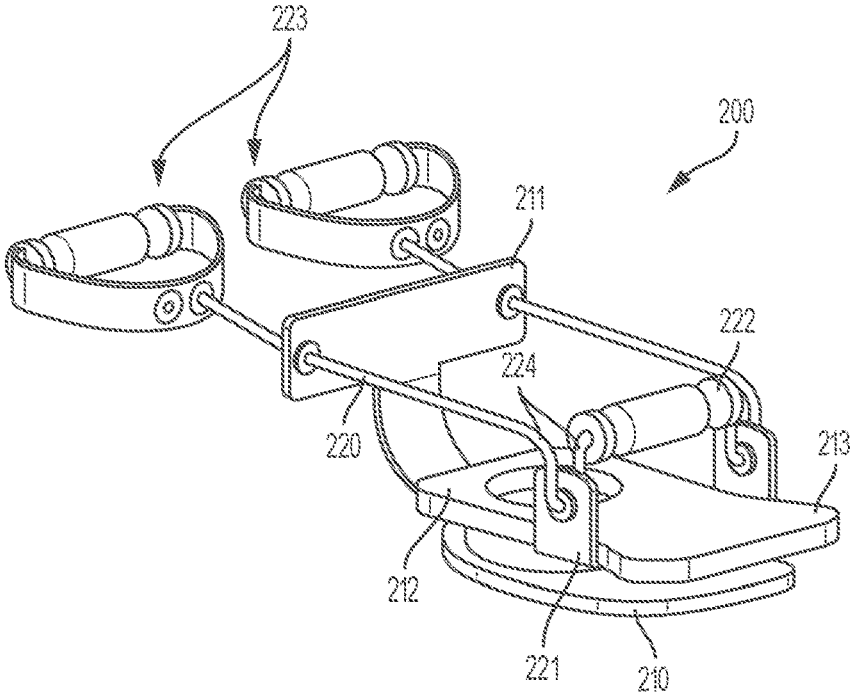
FIG. 5 is a front perspective view of a portable lower limb therapy device built in accordance with a back handle embodiment of the present invention with a platform member in a relaxed configuration.
Figure 6:
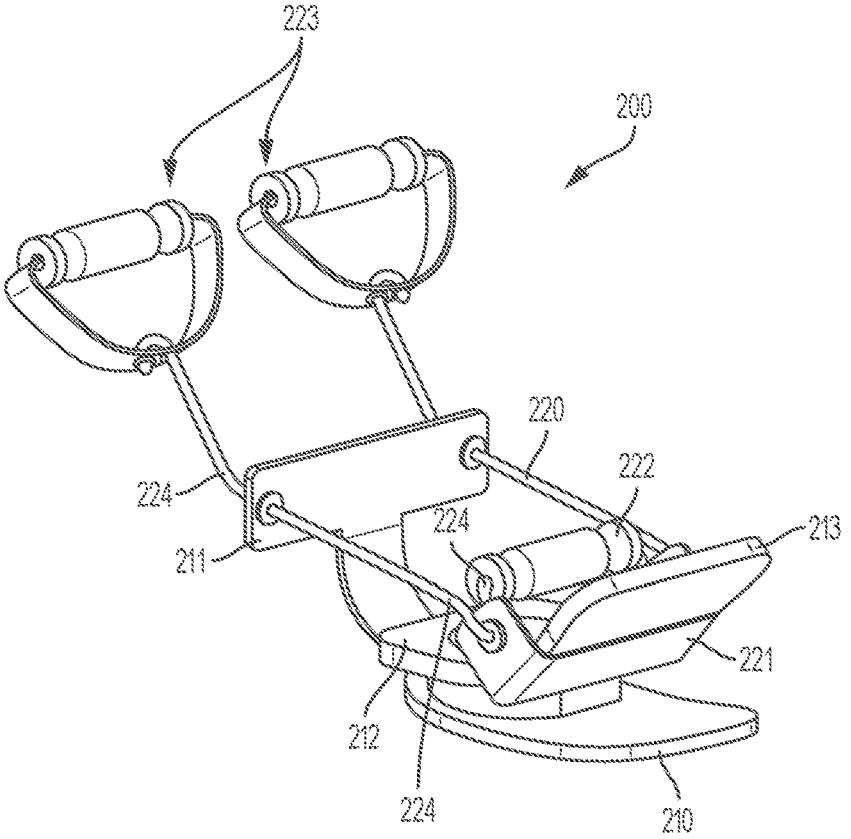
FIG. 6 is a front perspective view of a portable lower limb therapy device built in accordance with a back handle embodiment of the present invention with a platform member in a partially flexed configuration.
Figure 7:
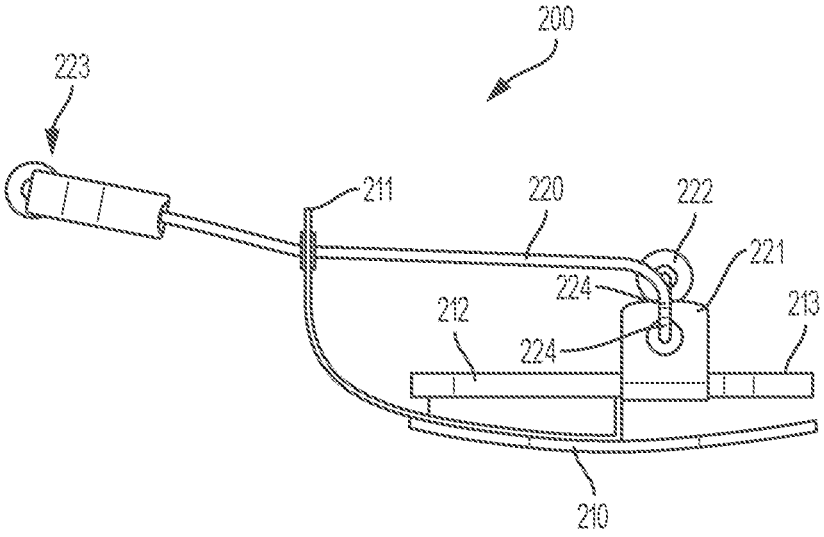
FIG. 7 is a side elevational view of a portable lower limb therapy device built in accordance with a back handle embodiment of the present invention with a platform member in a relaxed configuration.
Figure 8:
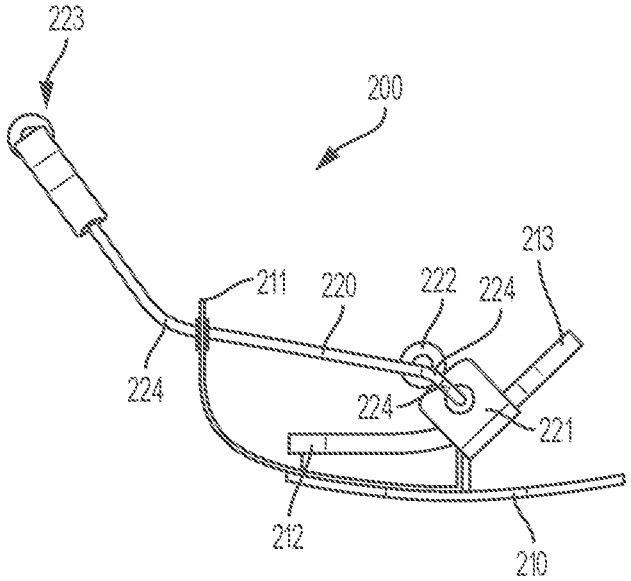
FIG. 8 is a side elevational view of a portable lower limb therapy device built in accordance with a back handle embodiment of the present invention with a platform member in a partially flexed configuration.
Figure 9:
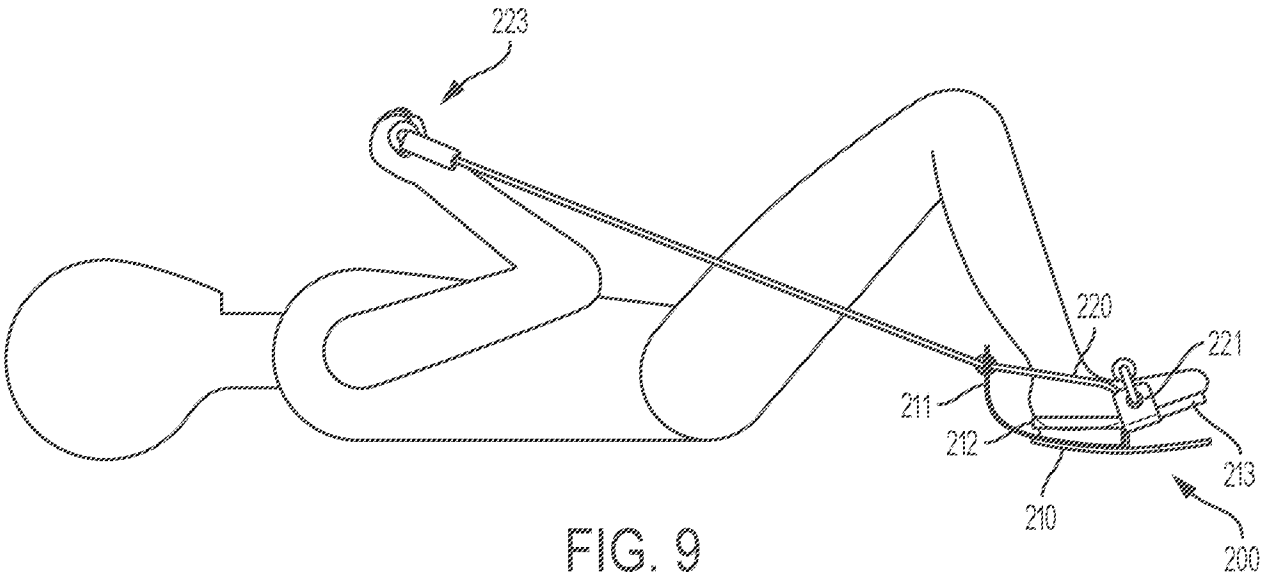
FIG. 9 is a side elevational view of a portable lower limb therapy device built in accordance with a back handle embodiment of the present invention with a platform member in a partially flexed configuration, shown with a patient's foot in place therein.
Figure 10:
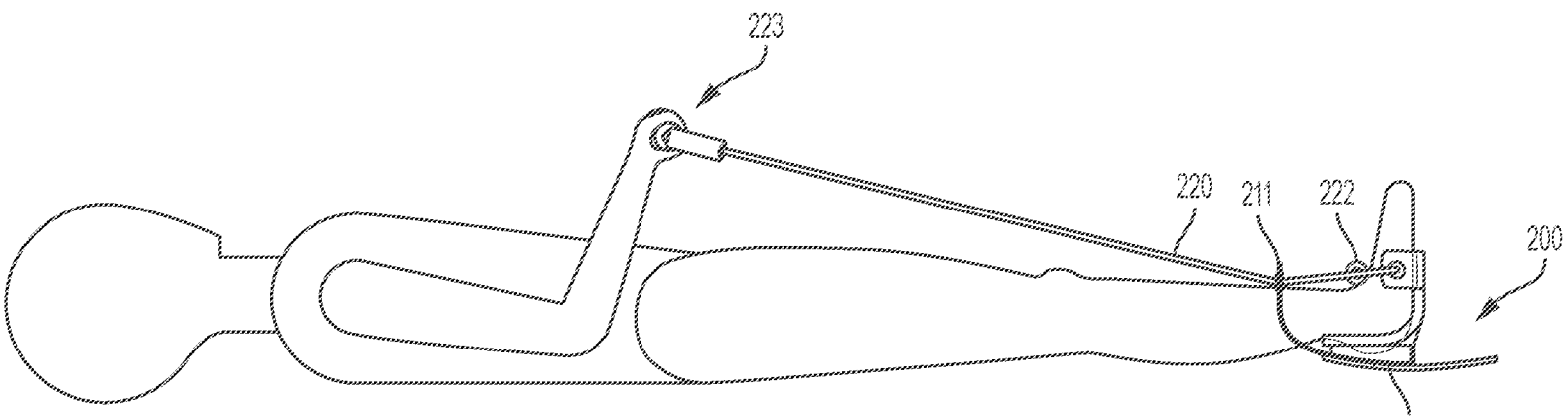
FIG. 10 is a side elevational view of a portable lower limb therapy device built in accordance with a back handle embodiment of the present invention with a platform member in a fully flexed configuration, shown with a patient's foot in placed therein.
Figure 11:
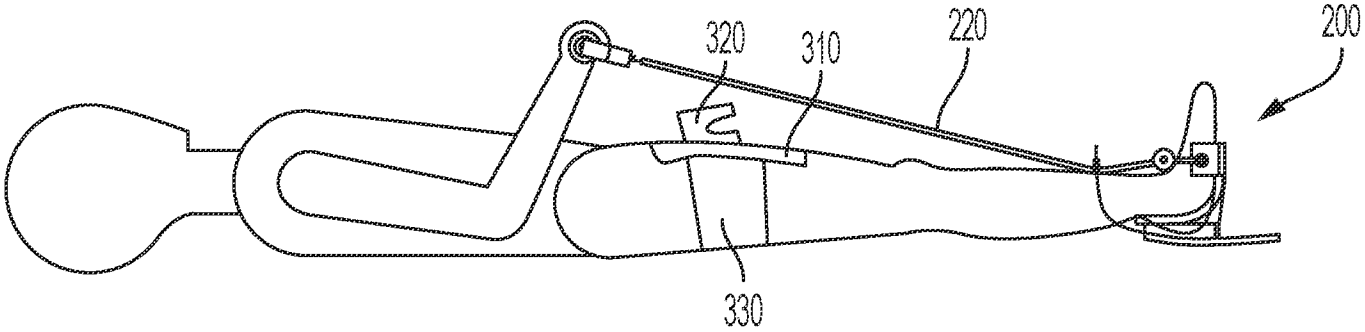
FIG. 11 is a side elevational view of a wearable anchor for a portable lower limb therapy device built in accordance with a single strap embodiment of the present invention, shown on a patient's leg along with a back handle embodiment of the portable lower limb therapy device on the patient's foot.
Figure 12:
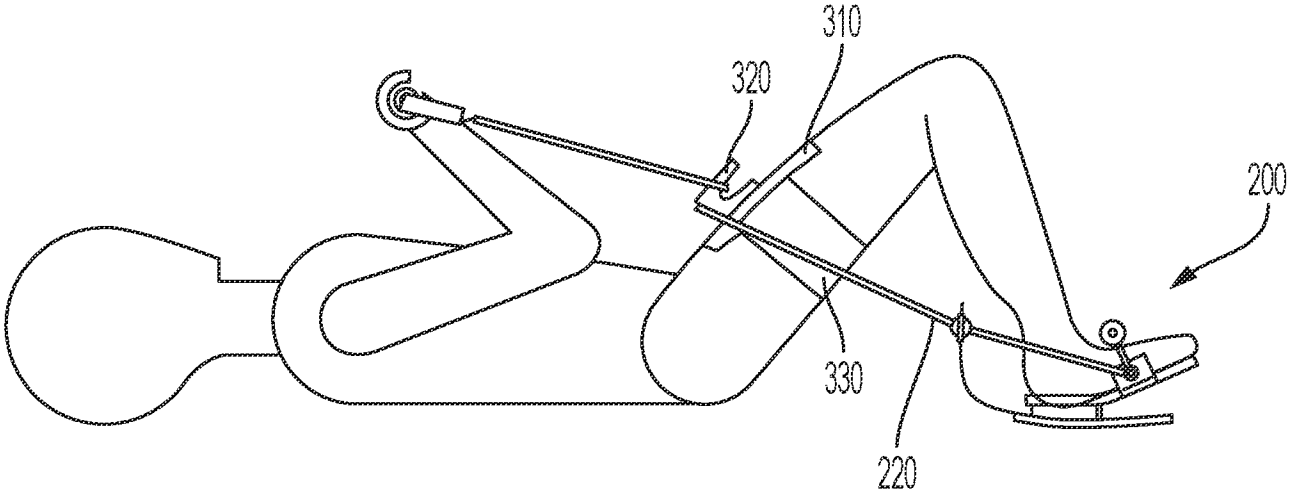
FIG. 12 is a side elevational view of a wearable anchor for a portable lower limb therapy device built in accordance with a single strap embodiment of the present invention, shown on a patient's leg along with the cord member of a back handle embodiment of the portable lower limb therapy device that is on the patient's foot fastened therein.
Figure 13:
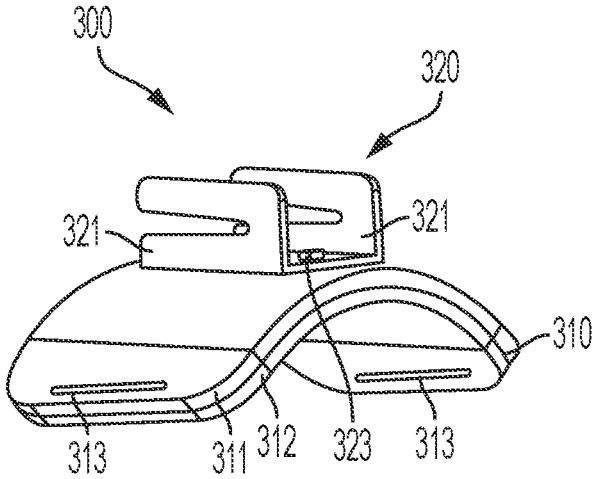
FIG. 13 is a side perspective view of a wearable anchor for a portable lower limb therapy device built in accordance with a single strap embodiment of the present invention.
Figure 14:
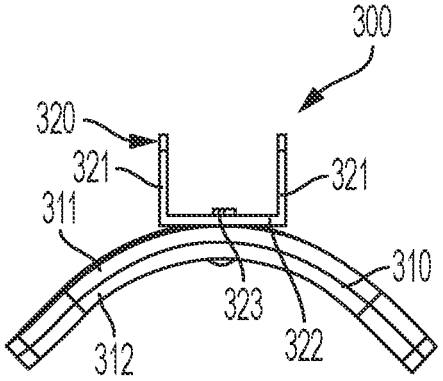
FIG. 14 is a front elevational view of a wearable anchor for a portable lower limb therapy device built in accordance with a single strap embodiment of the present invention.
Figure 15:
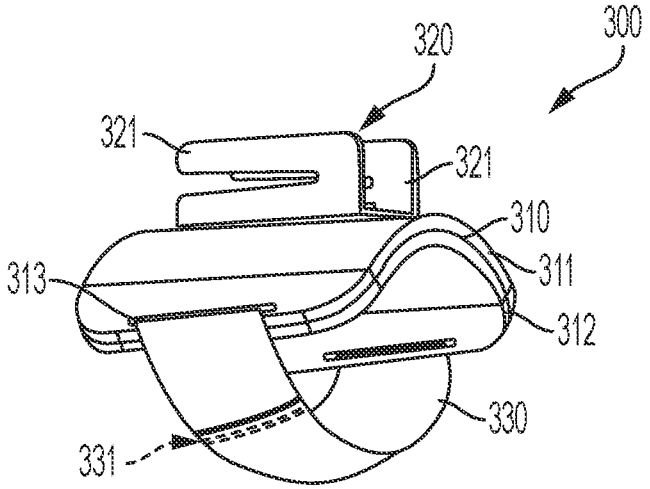
FIG. 15 is a side perspective view of a wearable anchor for a portable lower limb therapy device built in accordance with a single strap embodiment of the present invention, shown with a securing strap.
Figure 16:
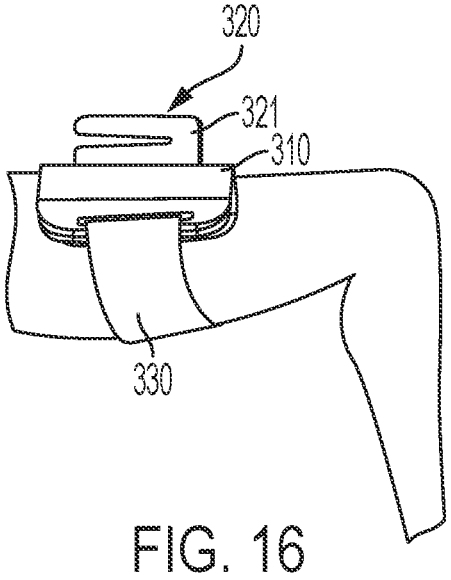
FIG. 16 is a side elevational view of a wearable anchor for a portable lower limb therapy device built in accordance with a single strap embodiment of the present invention, shown with a strap on a patient's leg.
Figure 17:
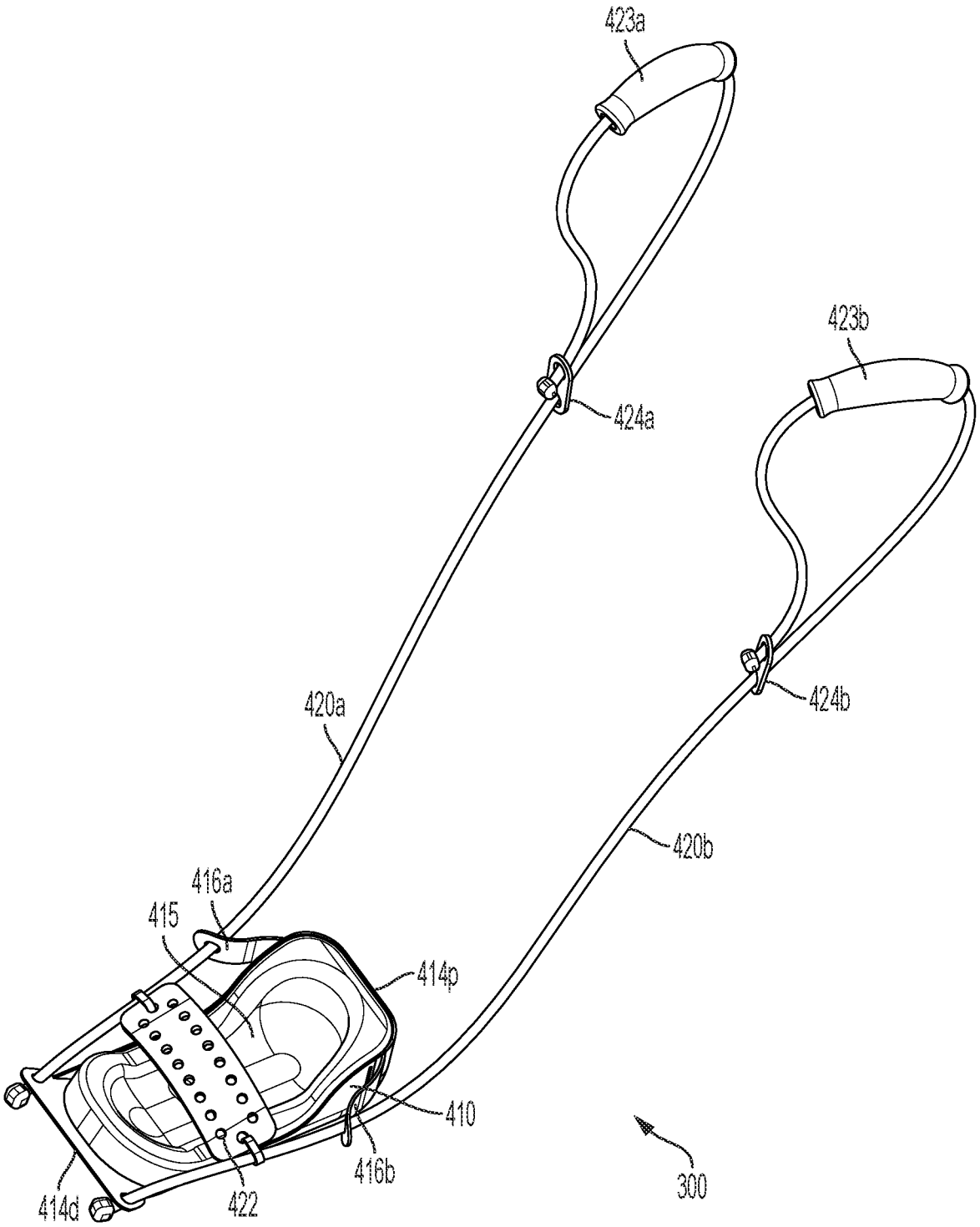
FIG. 17 is a side perspective view of a portable lower limb therapy device built in accordance with a dual cord back handle embodiment of the present invention.
Figure 18:
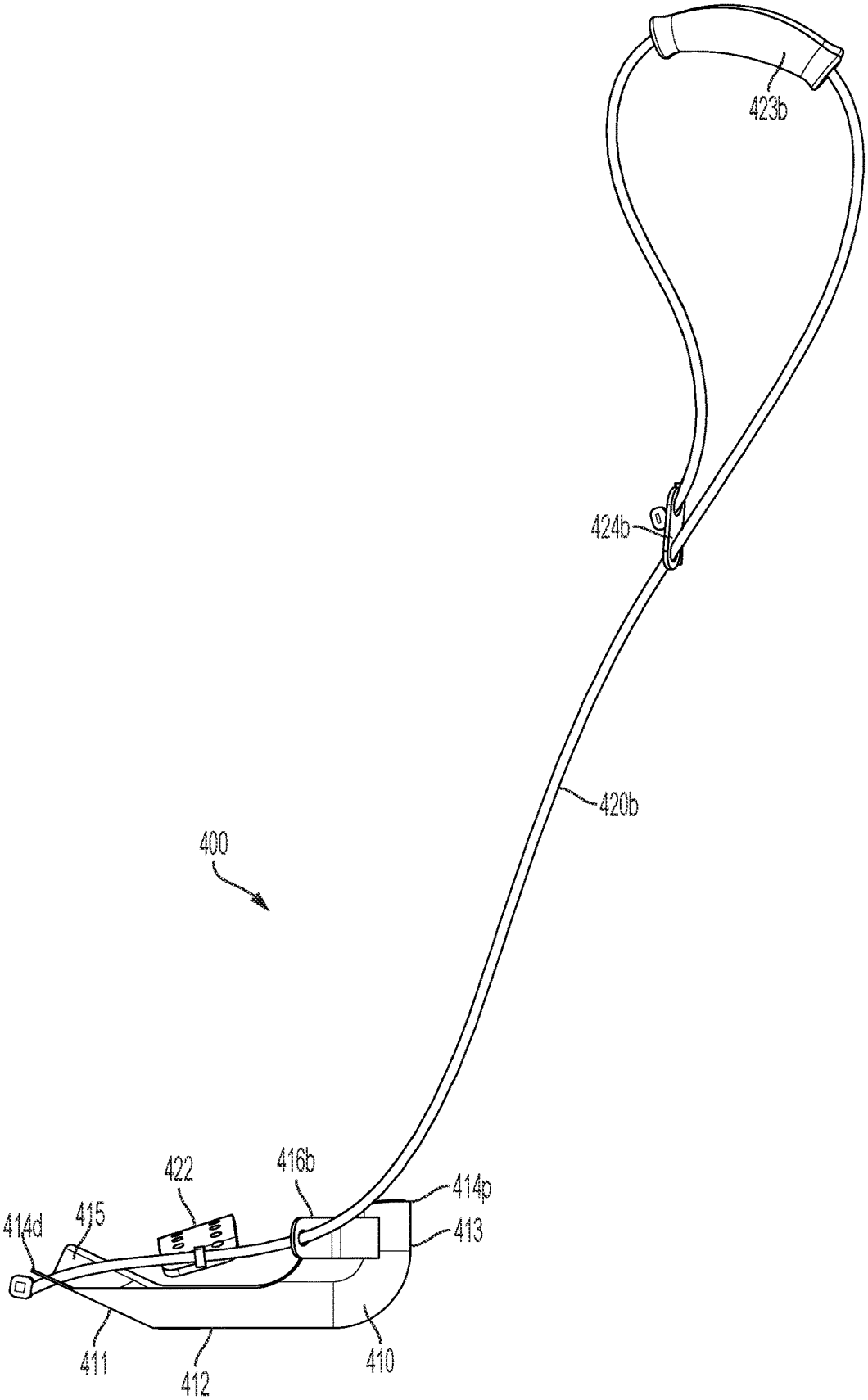
FIG. 18 is a side elevational view of a portable lower limb therapy device built in accordance with a dual cord back handle embodiment of the present invention.
Figure 19:
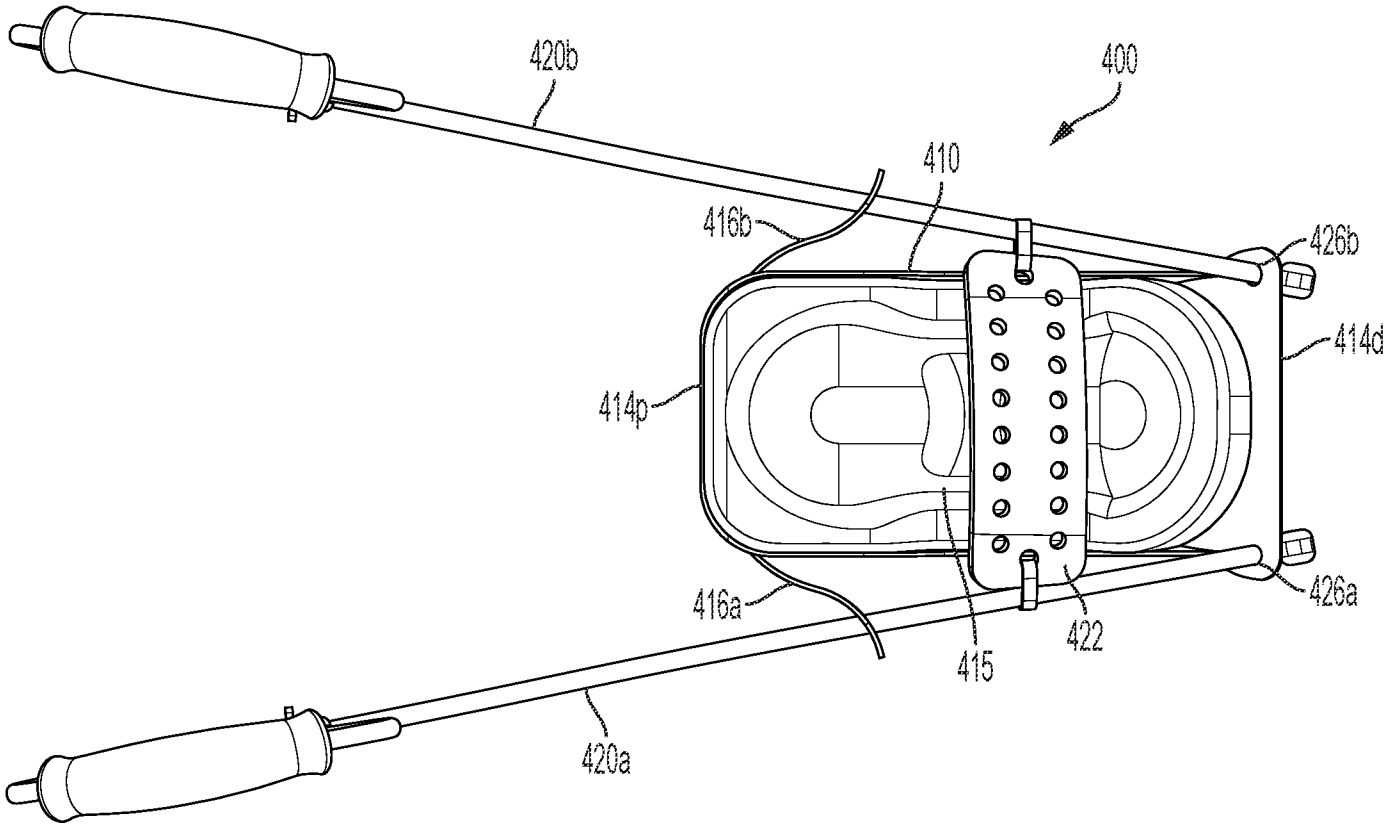
FIG. 19 is a top plan view of a portable lower limb therapy device built in accordance with a dual cord back handle embodiment of the present invention.
Figure 20:
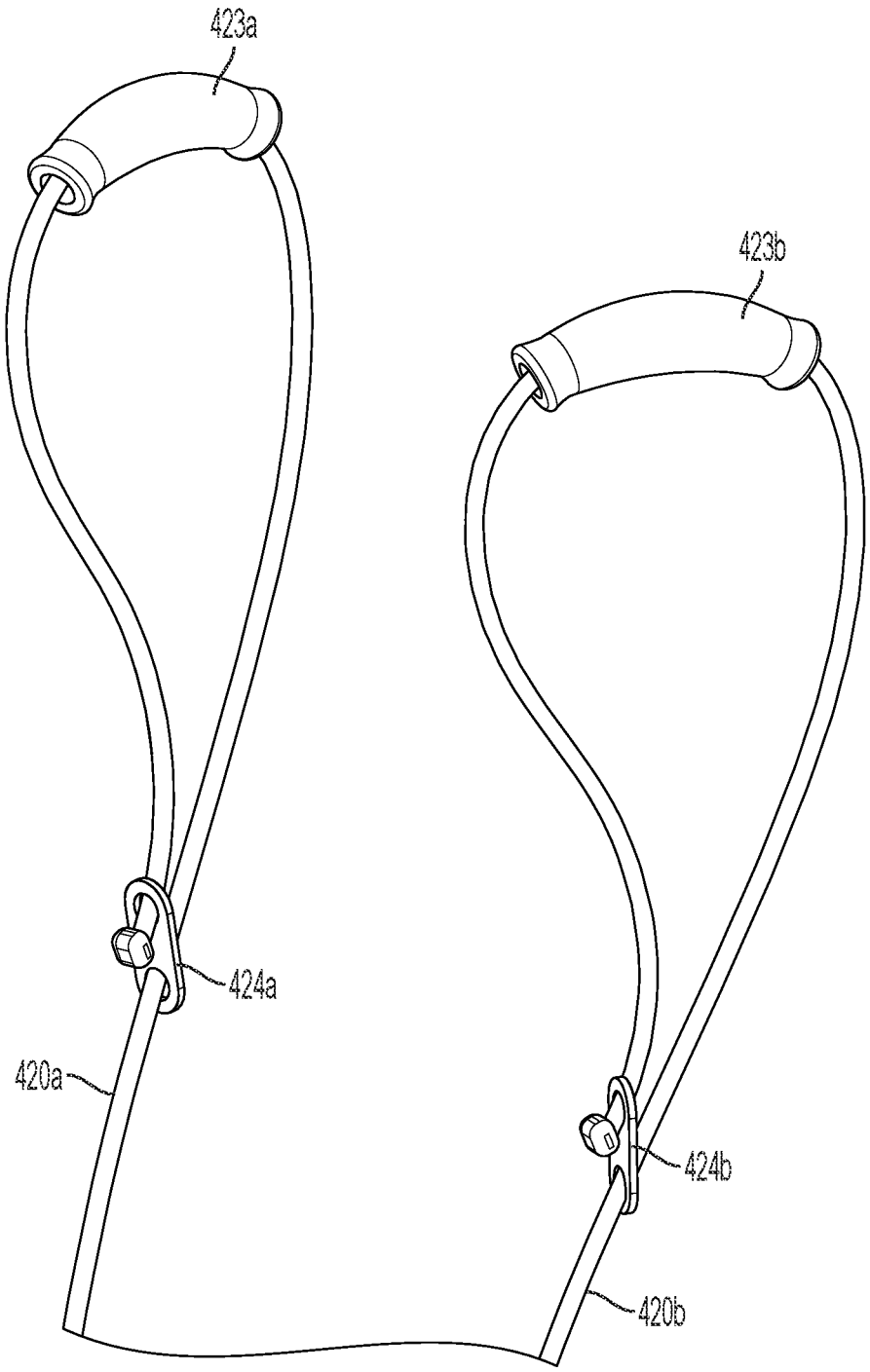
FIG. 20 is a partial side perspective view of a portable lower limb therapy device built in accordance with a dual cord back handle embodiment of the present invention showing the support base.
Figure 21:
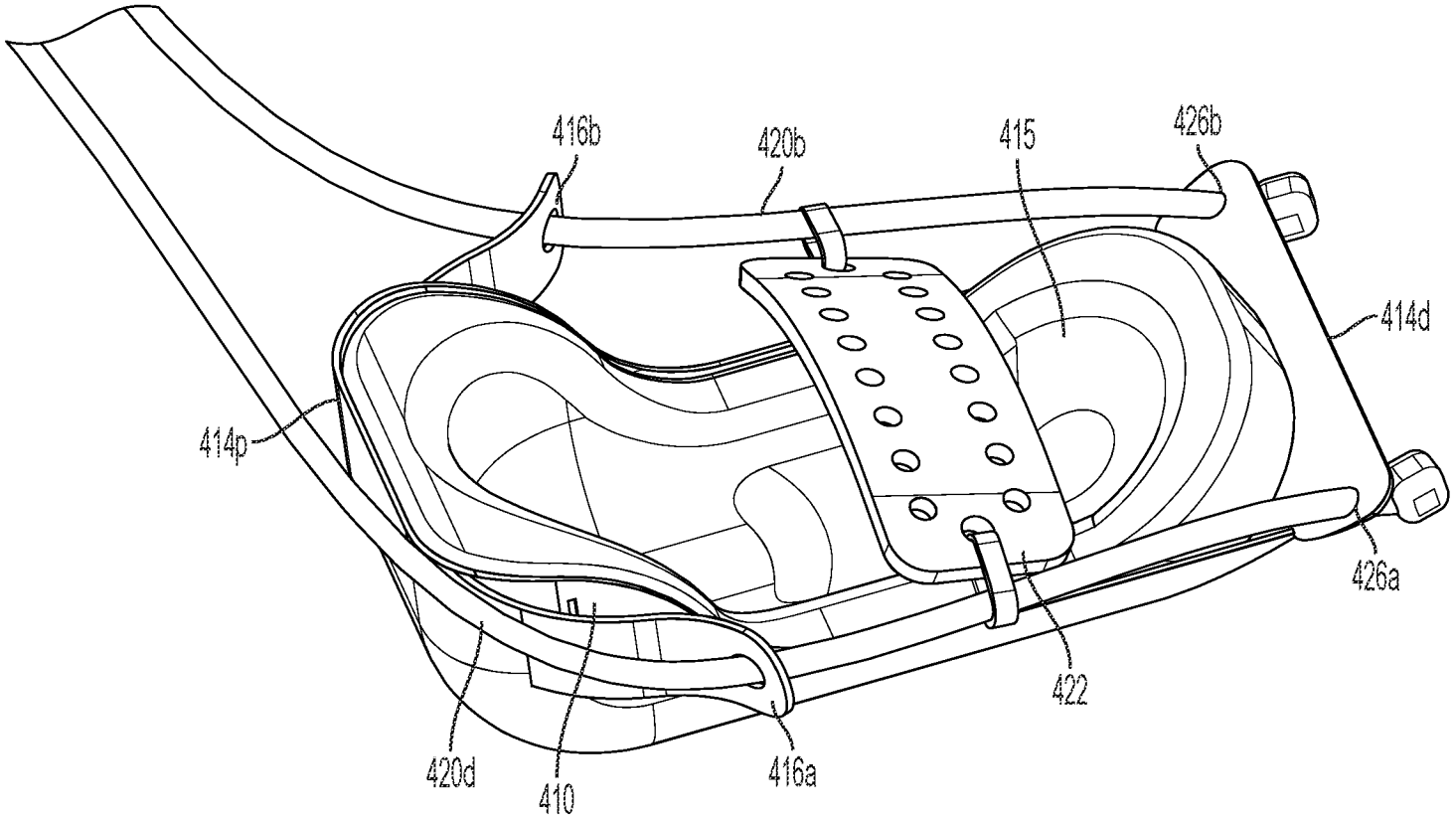
FIG. 21 is a partial side perspective view of a portable lower limb therapy device built in accordance with a dual cord back handle embodiment of the present invention showing the adjustable handle mechanisms.
Figure 22:
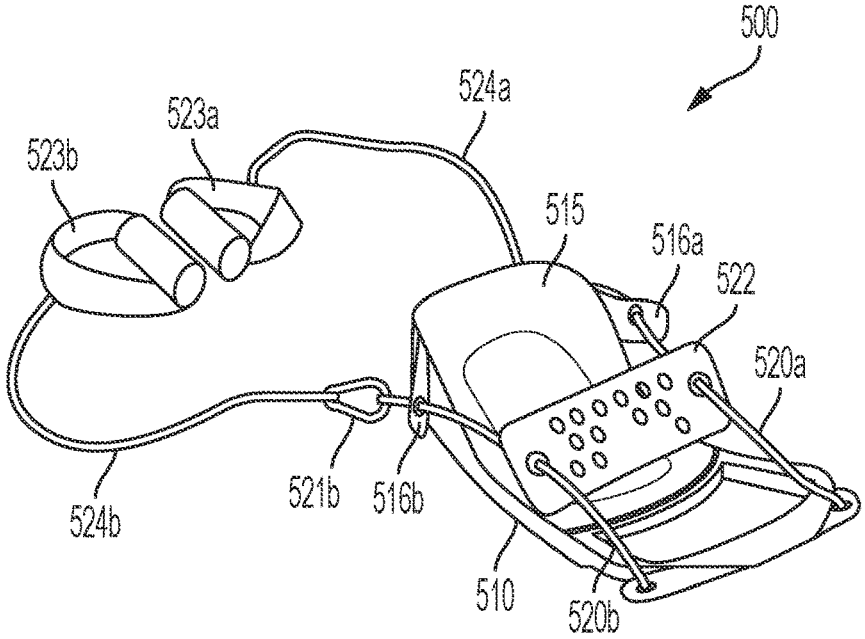
FIG. 22 is a front perspective view of a portable lower limb therapy device built in accordance with a dynamic tension embodiment of the present invention, shown without any dynamic bands integral therewith.

The distal portion 213 forms a forward portion of the platform pad 212 and may be movable relative to the rest of the platform pad 212 so as to be able to flex between an elevated position relative to the rest of the platform pad 212, as illustrated in FIG. 6, and a planar position relative to the rest of the platform pad 212, as illustrated in FIG. 5. It is appreciated that the distal portion 213 being in the elevated position, sitting diagonally relative to the rest of the platform pad 212, defines the flexed configuration of the rest of the platform pad 212 while the distal portion 213 being in the planar position, sitting in horizontal alignment with the rest of the platform pad 212, defines the relaxed configuration of the platform pad 212. It is further appreciated that the distal portion 213 being in the elevated position enables the placement of a foot of a user in a diagonal position relative to the slider 210 with the heel of the foot resting in the central aperture and the foot extending up therefrom onto the diagonally oriented distal portion 213, as illustrated in FIG. 6.

It is contemplated that the platform pad 212, including the distal portion 213, may be formed of a single, unitary structure that constructed of a flexible material so as to allow for the platform pad 212 to bend. In alternative embodiments, the platform pad 212 may include a flexible transverse portion that allows the platform pad 212 to bend or the platform pad 212 may be formed from two discrete structures connected by a hinge joint or other flexible material.

It is contemplated that the distal portion 213 being wider than the rest of the platform pad 212 may configure the distal portion 213 to receive and support portions of a user's foot having a greater width than the heel.

The slider 210 and back panel 211 may be constructed of hard plastic and the platform pad 212 may be constructed out of a substantially firm foam that can still bend when subjected to manual force in the manner described below.

The pulley system defines a closed force transfer system, arranged with the cord member 220 extending from the rear handle 223 on the right side of the portable lower limb therapy device 200, through an aperture in the back panel 211 positioned on the right side thereof, then through an aperture in the support member 221 positioned on the right side thereof, then through the cross member 222 entering on the right side and exiting on the left side of the portable lower limb therapy device 200, then through an aperture in the support member 221 positioned on the left side thereof, through an aperture in the back panel 211 positioned on the left side thereof and finally connecting to the rear handle 223 on the left side.

The handles 223 are each positioned behind the back panel 211, and may be constructed of or otherwise include foam. The handles 223 may be defined by a substantially cylindrical handle portion with a foam surface and a web type strap, with the web type strap connecting to the cord member 220 and to the handle portion to improve durability without sacrificing comfort.

The support member 221 defines a mechanical connector integrated with the platform pad 212, with a connection portion positioned on the right side of the platform pad 212 and a connection portion positioned on the left side of the platform pad 212. Each connection portion may include an aperture therein so as to configure it to allow the cord member 220 to pass through it. In addition, the support member 221 may be positioned underneath the distal portion 213.

The support member 221 may define a molded or web type strap that is attached to the bottom of the platform pad 212, with a portion extending beyond the platform pad 212 on both the right and left side so as to form the connection portions. The connection portions may include grommets integrated with the apertures therein. In an alternate embodiment, the support member 221 may be defined solely by two connection portions extending from either side of the platform pad 212.

The cross member 222 is positioned sufficiently above the platform pad 212 to allow the foot of a user that is resting on the platform pad 212 to slide underneath the cross member 222. The cross member 222 may be defined by a substantially cylindrical handle portion with a foam surface. The cross member 222 may be positioned directly above the support member 221 such that the cord member 220 travels vertically from the support member 221 on either side of the cross member 222 into the cross member 222 (when the platform pad 212 is in the planar position).

Notably, because the cord member 220 extends from the rear handle 223 on each side of the back panel 211, to and through the support member 221 on either side of the platform pad 212, the pulley system is configured to transfer force applied behind the back panel 211 to the platform pad 212. Similarly, because the cord member 220 connects on either end to one of the handles 223, passes through the support member 221 on either side of the platform pad 212, and passes through the cross member 222, the pulley system is configured to transfer force applied above a user's foot positioned on top of the platform pad 212 to the platform pad 212.

The pulley system may also include a plurality of rigid shafts 224 through which the cord member 220 passes. It is contemplated that the rigid shafts 224 may operate to hold the cord member 220 in position as it passes from one pulley system structure (i.e., back panel 211, support member 221, cross member 222) to the next and limit how close different pulley system structures can get to one another.

The cord member 220 may define an elongated, continuous line that may be constructed of a rope, strap, tubing, or cable. The cord member may be of an elastic material or a rigid material. In an alternate embodiment, however, the cord member 220 may be a plurality of cord members attached to the rigid shafts 224.

The back panel 211 may include grommets integral with the apertures through which the cord member 220 passes.

It is contemplated that a user having their foot positioned in the portable lower limb therapy device 200 may exert mechanical force on the lower limb therapy device 200 with their upper body (as passive motion) by grabbing either the handles 223 or the cross member 222. In this regard, the lower limb therapy device 200 enables pulling, pushing and lifting actions. When using passive motion with this device, the upper body limbs provide 100% of the energy. The energy requirements to raise and lower the lower limb can be selectively distributed in real time by a user through by using both the upper and lower limbs (at various levels of force). This feature provides the opportunity to scale up from 0% to 100% of the lower limb's force requirement limb to perform hip and knee flexion and extension, hip abduction and hip circumduction (as the lower limb therapy device 200 is not on a track and can move in any direction, circumduction an available therapy motion option). Indeed, the pulley system enables a user to control the motion and the speed at which the lower limb moves as it is being flexed and extended thru various planes.

Moreover, because of the slider 210 can move on substantially any type of smooth surface, the lower limb therapy device 200 provides a means to support the weight of a user's lower limb and allow the limb to slide and glide even on uneven surfaces as a bed or therapy table.

Referring now to FIGS. 11, 12, 13, 14, 15, and 16, a wearable anchor 300 for a therapy device is shown having a support frame 310, a locking component 320, and a securing strap 330. The support frame 310 may define an arcuate body that is sized to be placed on and contour to the thigh of a user and thereby configured to be placed against a user's body. The support frame 310 may be constructed out of hard plastic or other substantially rigid material. It is contemplated, however, that the support frame 310 may alternatively include a hard plastic top layer 311 and a padded bottom layer 312 such that the portion of the support frame 310 that is pressed against a user's thigh is cushioned.

As an arcuate member, it is contemplated that the support frame 310 has a top surface and a bottom surface, with bottom surface being the aspect thereof that is placed against a user's body. Disposed on the top surface of the support frame 310 is a locking component 320. The locking component 320 may include a pair of slot members 321 which extend up vertically from the top surface of the support frame 310, with the slot members 321 attached to one another by a component base 322 which runs horizontally across the top surface of the support frame 310. In such a configuration, the locking component 320 may be attached to the support frame 310 with a single elongated fastener or a plurality of elongated fasteners, such as bolts 323. As the support frame 310 is structured to lay on top a user's thigh with its top surface (and bottom surface) having the same orientation as the user's thigh, such a design results in the slot members 321 being oriented in a manner in which they extend substantially perpendicular to the user's thigh.

Each of the slot members 321 may include a tapered slot in which the cord member 220 of a portable lower limb therapy device 200 of the type discussed with reference to FIGS. 4-10 (or other device that includes cords) may be wrapped around and secured in. In this regard, the slot members 321 with their tapered slots configure the locking mechanism to receive and selectively secure a cord. In such a configuration, the locking component 320 may be attached to the support frame 310 with a single elongated fastener or a plurality of elongated fasteners, such as bolts 323. The tapered slots may be oriented in the slot members 321 such that they extend into the body of the slot member 321 and are substantially parallel to the component base 322 as well as a user's thigh when the wearable anchor 300 is in place on the user.

The securing strap 330 may define an elongated band that includes an attachment mechanism 331, such as corresponding portions of a hook and loop fastener, integral therewith so as to allow one end of the securing strap 330 to releasably attach to another portion thereof. The support frame 310 may additionally include a pair of apertures 313 therein adjacent to each end which are sized to receive the securing strap 330 and allow the securing strap 330 to loop through it. In this regard, by placing the support frame 310 on a user's thigh, looping the securing strap 330 through the apertures 313, and attaching the end of the securing strap 330 to another portion of the securing strap 330, the support frame 310 can be releasably secured to the thigh of a user. Further, the apertures 313 along with the securing strap 330 operate to configure the support frame to be secured to a user's body.

In use, the wearable anchor 300 for a therapy device may be first strapped to patient's thigh. Then patient simply slips the cords from a therapy device, such as the portable lower limb therapy device, in and around the tapered slots of the slot members 321. This action operates to securely fasten the cords from the portable lower limb therapy device in a locked position so that patient can remove hands from the cord. The wearable anchor 300 allows any patient using the portable lower limb therapy device to attain and maintain a static-progressive stretch by a mechanical means rather than a manual means. Presently, in order for patient to engage in static progressive stretching techniques, the patient must manually hold a cord/pulley system in place themselves to attain a static position. The wearable anchor 300, however, will allow patient to engage in a series of static-progressive stretching motions with without ongoing exertion to hold cords. So rather than patient having to hold a fixed static position for several minutes at a time, which can be tiring to the patient's arms, patient now can simply anchor the he portable lower limb therapy device cord to the wearable anchor 300 and remove hands from the cord. At this time patient will have achieved a lock of the knee, thus allowing for a static load on the joint.

When appropriate, patient can unlocks the cord wearable anchor 300 and pulls back on cord to create more flexion. This is known as the progressive stretch. After patient creeps the knee a little further into flexion then patient again anchors down the cord, thus creating a new static stretch with greater flexion. All without having to constantly use their hands/arms.

During the healing process after injury or surgery the connective tissue around the joint may shorten or start to form scar tissue which will restrict the knee's range of motion. This will delay patient's rehab efforts and may lead to prolonged complications and loss of quality of life if patient is unable to regain full flexion and or extension of their knee. Static-progressive stretching techniques have been medically proven to breakdown scar tissue and restore full range of motion. When patient engages in static-progressive therapy the scar tissue breaks down and connective tissue is as able to properly stretch out allowing for full range of motion.

Static Progressive therapy works by applying a static force to the joint 3 to 4 times per day for 15 to 20 minute sessions. Static force applied to the joint over time will allow for plastic deformation of connective tissue. This allows for patient to progress in their therapy by engaging in more aggressive knee bends over time, and again applying a load every time they reach a new flexion point. This continues on until full range of motion is achieved. Treatment typically lasts 2 to 4 months. By restoring range of motion in this manner, a patient is able to heal quicker, recapture quality of life and avoid future complications.

Referring now to FIGS. 17, 18, 19, 20, and 21, a portable lower limb therapy device 400 built in accordance with a dual cord back handle embodiment is shown having a support base and a pulley system. The support base has a rigid frame 410 that forms an exterior surface of the support base and includes a front toe portion 411, a bottom sole portion 412, and a back heel portion 413. The front toe portion 411, bottom sole portion 412, and back heel portion 413 together to form a contiguous shell, with the back heel portion 413 forming the proximal end 414*p* of the support base, the front toe portion 411 extending to the distal end 414*d* of the support base, and bottom sole portion 412 positioned between the back heel portion 413 and the front toe portion 411.

The support base also includes a resilient pad member 415 that is attached to and substantially covers one side of the frame 410, forming an interior surface of the support base that is configured to receive a foot of a user.

The pulley system defines a closed force transfer system and includes two cord members 420*a*, 420*b*, a cross member 422, two handle pads 423*a*, 423*b*, and two adjustment members 424*a*, 424*b*. With respect to the positioning of these components, a right cord member 420*a* is connected to and has a portion that runs alongside the right side of the support base and a left cord member 420*b* is connected to and has a portion that runs alongside the left side of the support base. While it runs alongside the right side of the support base, the right cord member 420*a* passes through the right side of the cross member 422. Similarly, while it runs alongside the left side of the support base, the left cord member 420*b* passes through left side of the cross member 422. A right handle pad 423*a* and a right adjustment member 424*a* are integral with a portion of the right cord member 420*a* that extends away from the support base, while a left handle pad 423*b* and a left adjustment member 424*b* are integral with a portion of the left cord member 420*b* that extends away from the support base.

The pulley system integrates with the support base to allow force exerted on pulley system to be transferred to the support base through a pair of proximal connectors and a pair of distal connectors 426*a*, 426*b*. The distal connectors 426*a*, 426*b* may each be defined by distal apertures in the front toe portion 411 of the frame 410 that are adjacent to the distal end 414*d*, with the distal apertures sized to allow one of the cord members 420*a*, 420*b* to pass through it. The proximal connectors may be defined by a pair of connector flaps 416*a*, 416*b* which extend from the frame 410 at a location adjacent to the proximal end 414*p*, with each of the connector flaps 416*a*, 416*b*, having a flap aperture sized to allow one of the cord members 420*a*, 420*b* to pass through it. It is contemplated that a knots or other enlarged structure at the end of the cord members 420*a*, 420*b* may be used to ensure that the end of the right cord member 420*a* and the left cord member 420*b* does not pass through the right distal connector 426*a* and left distal connector 426*b*, respectively.

In this regard, the pulley system is integrated with the support base with the right cord member 420*a* extending from a right distal connector 426*a* that is on the right side of the front toe portion 411 and passing through a right connector flap 416*a* that is on the right side of the frame 410, and with the left cord member 420*b* extending from a left distal connector 426*b* that is on the left side of the front toe portion 411 and passing through a left connector flap 416*b* that is on the left side of the frame 410. Once the right cord member 420*a* and left cord member 420*b* pass through the respective connector flaps 416*a*, 416*b*, they may extend away from the frame 410 and integrate with a right handle pad 423*a* and a right adjustment member 424*a* on one hand, and a left handle pad 423*b* and a left adjustment member 424*b* on the other, to form a right adjustable handling mechanism and a left adjustable handling mechanism, respectively. The handle pads 423*a*, 423*b* may be constructed of a foam or other resilient material. The adjustment members 424*a*, 424*b* may each be defined by a slip lock style structure which provides locking force while the associated cord members 420*a*, 420*b* are under tension (as they would be while being pulled by a user). The right handle pad 423*a* and the right adjustment member 424*a* may be slidably disposed on the right cord member 420*a* to allow the distance between the right handle pad 423*a* and the frame 410 (i.e., the functional length of the right cord member 420*a*) to be adjusted. Similarly, left handle pad 423*b* and the left adjustment member 424*b* may be slidably disposed on the left cord member 420*b* to allow the distance between the left handle pad 423*b* and the frame 410 (i.e., the functional length of the left cord member 420*b*) to be adjusted.

In between where the right cord member 420*a* passes through the right distal connector 426*a* and where the right cord member 420*a* passes through the right connector flap 416*a*, the right cord member 420*a* passes through an aperture on the right side of the cross member 422. Similarly, in between where the left cord member 420*b* passes through the left distal connector 426*b* and where the left cord member 420*b* passes through the left connector flap 416*b*, the left cord member 420*b* passes through an aperture on the left side of the cross member 422. In this regard, the cross member 422 extends across the support base over top of the pad member 415.

In use, it is contemplated that a user may place their foot in the interior surface of the support base, with the foot resting on the pad member 415 with the user's heel towards the back heel portion 413 and toes toward the front toe portion 411. In such a position, the user's foot would be beneath the cross member 422. The exterior surface of the support base may define a rigid member which includes flat and curved portions and has a generally smooth bottom surface and back surface that limits friction and allows it slide and glide when placed on other surfaces As with the other embodiments, the pulley system is configured to transfer force applied behind the back heel portion 413 and force applied above a user's foot positioned in the support base, to the front toe portion 411 and the bottom sole portion 412. Similarly, it is contemplated that a user having their foot positioned in the lower limb therapy device 400 may exert mechanical force on the lower limb therapy device 400 with their upper body (as passive motion) by grabbing either the handle pads 423*a*, 423*b* or the cross member 422. In this regard, the lower limb therapy device 400 enables pulling, pushing and lifting actions. When using passive motion with this device, the upper body limbs provide 100% of the energy. The energy requirements to raise and lower the lower limb can be selectively distributed in real time by a user through by using both the upper and lower limbs (at various levels of force). This feature provides the opportunity to scale up from 0% to 100% of the lower limb's force requirement limb to perform hip and knee flexion and extension, hip abduction and hip circumduction (as the lower limb therapy device 400 is not on a track and can move in any direction, circumduction an available therapy motion option). Indeed, the pulley system enables a user to control the motion and the speed at which the lower limb moves as it is being flexed and extended thru various planes.

Moreover, because of the frame 410 can move on substantially any type of smooth surface, the lower limb therapy device 400 provides a means to support the weight of a user's lower limb and allow the limb to slide and glide even on uneven surfaces as a bed or therapy table.

It is appreciated that in addition to being used for rehabilitation related purposes, the portable lower limb therapy device in accordance with any embodiment can also be used by a user or patient that has limited ability to move or no ability to move their lower limbs (such as someone that is paralyzed from the waist down). For such a user, the portable lower limb therapy device can allow the user to stretch and work the muscles in a leg and/or foot by placing the targeted foot (or foot of the targeted leg) in the portable lower limb therapy device and using force applied solely from the user's arms to lift and position the leg in a manner that causes the muscles in the target foot and/or leg to stretch or otherwise be worked (particularly because the user can move the leg and any direction). Advantageously, such an act can allow the user to improve blood flow in the lower limb and otherwise better maintain the health of the lower limb.

Referring now to FIGS. 22, 23, 24, 25, 26, 27, and 28 a portable lower limb therapy device 500 built in accordance with a dynamic tension embodiment is shown having a support base and a pulley system. The support base has a rigid frame 510 and a resilient pad member 515, each of which are formed as the frame and pad member in the support base of the portable lower limb therapy device built in accordance with the dual cord back handle embodiment, as described with reference to FIGS. 17, 18, 19, 20, and 21.

The pulley system defines a closed force transfer system and includes two connector members 520*a*, 520*b*, two attachment clips 521*a*, 521*b*, a cross member 522, two handle members 523*a*, 523*b*, and two handle extension members 524*a*, 524*b*. With respect to the positioning of these components, a right connector member 520*a* is connected to and runs alongside the right side of the support base and a left connector member 520*b* is connected to and runs alongside the left side of the support base. While it runs alongside the right side of the support base, the right connector member 520*a* passes through the right side of the cross member 522. Similarly, while it runs alongside the left side of the support base, the left connector member 520*b* passes through left side of the cross member 522.

The right connector member 520*a* and the left connector member 520*b* may be constructed out of a durable cord, such as a nylon rope or other similar material.

The right connector member 520*a* and the left connector member 520*b* each terminate after passing through a right connector flap 516*a* and a left connector flap 516*b*, respectively, which are each part of the support base. At the terminal end of the each of the right connector member 520*a* and the left connector member 520*b*, a right attachment clip 521 and a left attachment clip 521*b*, respectively, may be removably attached. The right attachment clip 521*a* and left attachment clip 521*b* may each be defined by a carabiner clip.

The right attachment clip 521*a* and left attachment clip 521*b* may allow the two handle extension members 524*a*, 524*b* to be selectively connected to the connector members 520*a*, 520*b* and thus the frame 510, thereby allowing the portable lower limb therapy device 500 to function in a similar manner to that described with reference to FIGS. 17, 18, 19, 20, and 21.

The right attachment clip 521*a* and left attachment clip 521*b* also allow for the two handle extension members 524*a*, 524*b* to be selectively disconnected from the connector members 520*a*, 520*b*, and for a right dynamic cord member 525*a* and a left dynamic cord member 525*b*, respectively, to be removably connected to the right connector member 520*a* and the left connector member 520*b*, respectively. As such, the right attachment clip 521*a* and left attachment clip 521*b* allows for the placement of dynamic cord members 525*a*, 525*b* placed between the connector members 520*a*, 520*b* on one hand, and the handle extension members 524*a*, 524*b* on the other. In such a configuration, a right band coupling clip 526*a* and a left band coupling clip 526*b* may be additionally employed to allow the right dynamic cord member 525*a* and left dynamic cord member 525*b*, respectively, to be coupled with the right handle extension member 524*a* and left handle extension members 524*b*.

Figure 23:
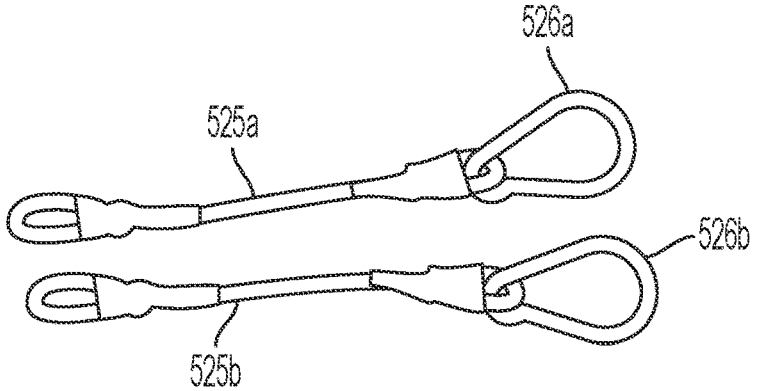
FIG. 23 is an elevational view of the six pound dynamic bands of a portable lower limb therapy device built in accordance with a dynamic tension embodiment of the present invention, shown with attachment clips coupled therewith.
Figure 24:
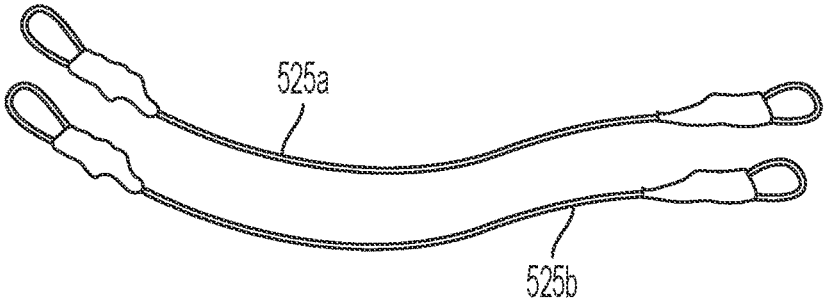
FIG. 24 is an elevational view of the two pound dynamic bands of a portable lower limb therapy device built in accordance with a dynamic tension embodiment of the present invention.
Figure 25:
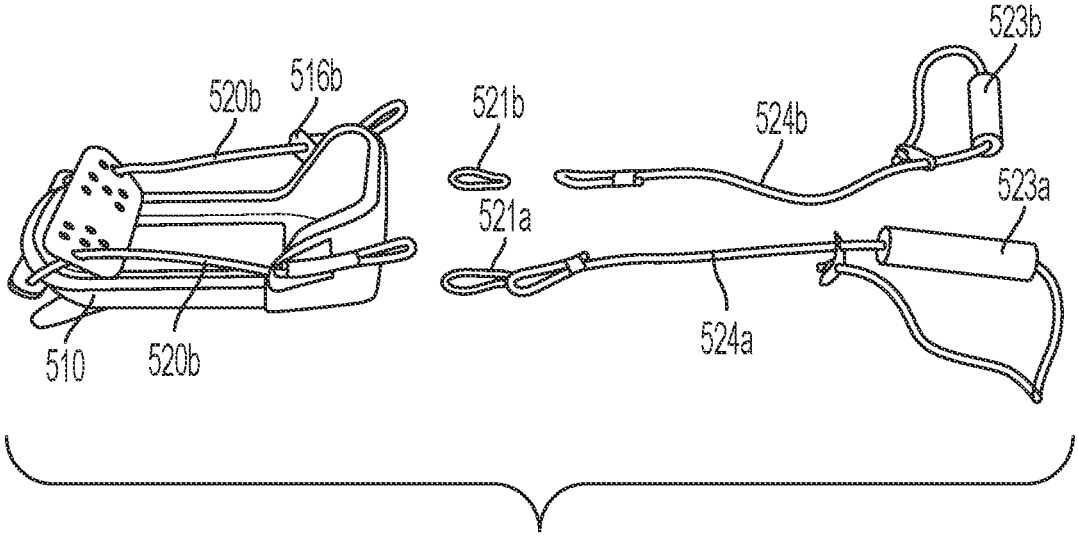
FIG. 25 is an exploded side perspective view of a portable lower limb therapy device built in accordance with a dynamic tension embodiment of the present invention, shown without any dynamic bands integral therewith.

The right dynamic cord member 525*a* and a left dynamic cord member 525*b* each may be defined by a dynamic tension band, or resistance band, which provides a predetermined amount of tension. For example, bands which provide six pounds of resistance are shown in FIG. 23 and bands which provide two pounds of resistance are shown in FIG. 24. By placing the dynamic cord members 525*a*, 525*b* in between the connector members 520*a*, 520*b* and the handle extension members 524*a*, 524*b* various levels of resistance can be integrated into the pulley system through the use of bands having varying levels of resistance (used individually or together) as the right dynamic cord member 524*a* and the left dynamic cord member 524*b*.

The right handle member 523*a* is integral with the end of the right handle extension member 524*a* opposite the end connected to the right connector member 520*a* or the right band coupling clip 526*a*, while a left handle member 523*b* is integral with the end of the left handle extension member 524*b* opposite the end connected to the left connector member 520*b* the left band coupling clip 526*b*.

The pulley system is integrated with the support base to allow force exerted on pulley system to be transferred to the support base by way of the right connector member 520*a* and the left connector member 520*b*, in the same way as the portable lower limb therapy device built in accordance with the dual cord back handle embodiment, as described with reference to FIGS. 17, 18, 19, 20, and 21. In this regard, the pulley system is integrated with the support base with the right connector member 520*a* extending from a right distal connector that is on the right side of a front toe portion and passing through the right connector flap 516*a* that is on the right side of the frame 510, and with the left connector member 520*b* extending from a left distal connector that is on the left side of a front toe portion and passing through the left connector flap 516*b* that is on the left side of the frame 510. Once the right connector member 520*a* and left connector member 520*b* pass through the respective connector flaps 516*a*, 516*b*, they are connected to respective handle extension members 524*a*, 524*b* (whether directly or by way of the dynamic cord members 525*a*, 525*b*) which extend away from the frame 510 and integrate with the right handle member 523*a* and the left handle member 523*b*, respectively, to form a right adjustable handling mechanism on one hand and a left adjustable handling mechanism on the other. The handle members 523*a*, 523*b* may include a handle portion made of foam or other resilient material. In addition, the handle members 523*a*, 523*b*, in conjunction with the handle extension members 524*a*, 524*b*, may be structured to form an adjustable handling mechanism in the same form as described with reference to FIGS. 17, 18, 19, 20, and 21 (illustrated in FIG. 25).

In between where the right connector member 520*a* passes through the right distal connector and where the right connector member 520*a* passes through the right connector flap 516*a*, the right connector member 520*a* passes through an aperture on the right side of the cross member 522. Similarly, in between where the left connector member 520*b* passes through the left distal connector and where the left connector member 520*b* passes through the left connector flap 516*b*, the left connector member 520*b* passes through an aperture on the left side of the cross member 522. In this regard, the cross member 522 extends across the support base.

Figure 26:
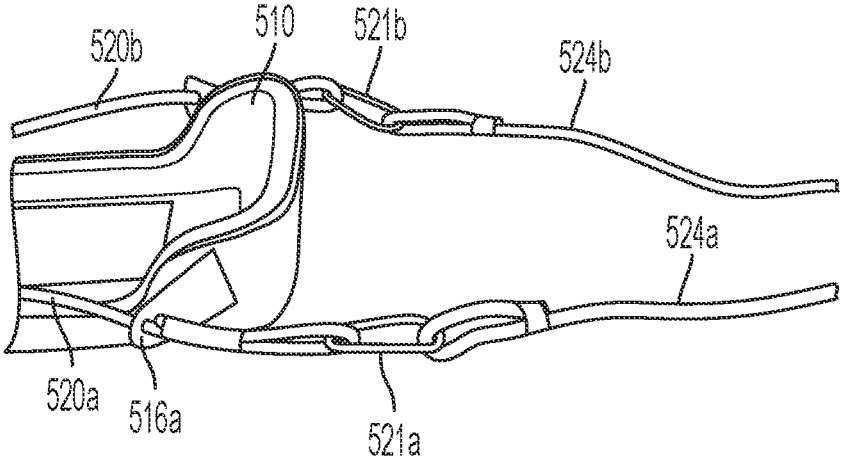
FIG. 26 is a partial side perspective view of a portable lower limb therapy device built in accordance with a dynamic tension embodiment of the present invention, shown without any dynamic bands integral therewith.
Figure 27:
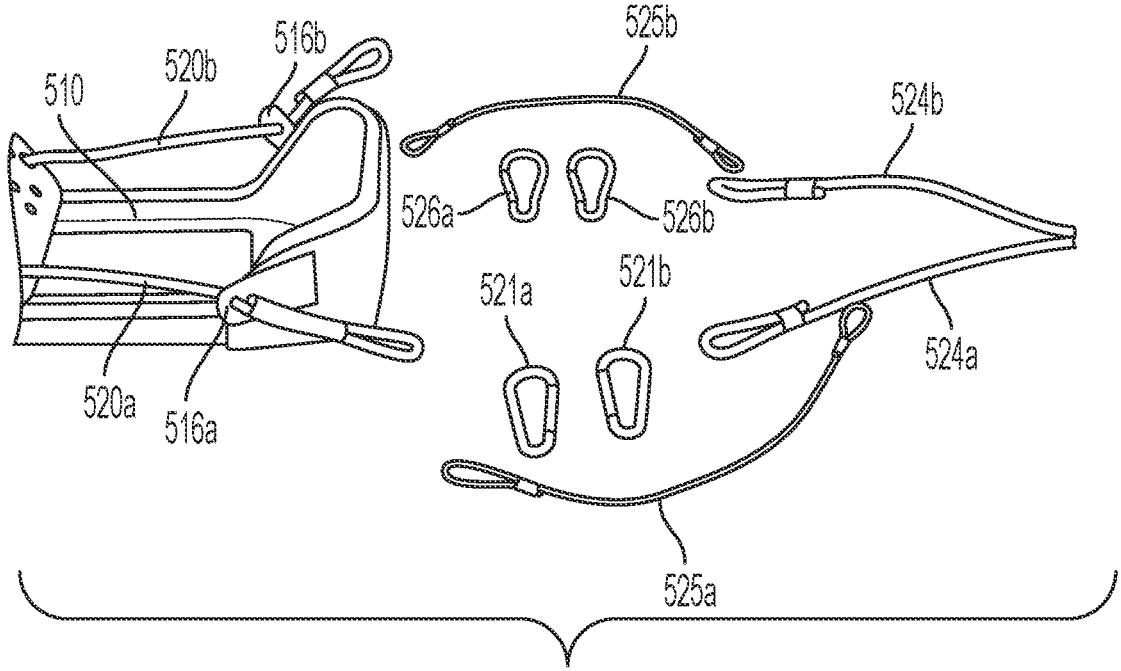
FIG. 27 is a partial exploded side perspective view of a portable lower limb therapy device built in accordance with a dynamic tension embodiment of the present invention, shown with dynamic bands.
Figure 28:
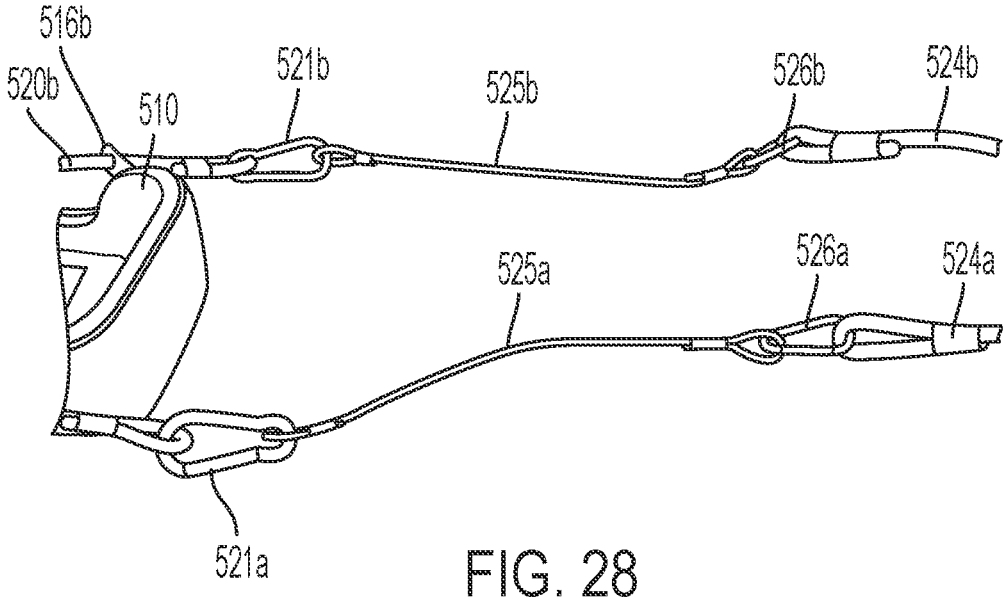
FIG. 28 is a partial side perspective view of a portable lower limb therapy device built in accordance with a dynamic tension embodiment of the present invention, shown with dynamic bands integral therewith

In use, it is contemplated that a user may place their foot in the interior surface of the support base as described with reference to the portable lower limb therapy device built in accordance with the dual cord back handle embodiment, as described with reference to FIGS. 17, 18, 19, 20, and 21. As with the other embodiments, the pulley system is configured to transfer force applied behind the back heel portion and force applied above a user's foot positioned in the support base, to the front toe portion and the bottom sole portion of the support base. For example, it is contemplated that when the portable lower limb therapy device 500 may be used with the handle extension members 524*a*, 524*b* coupled directly with the connector members 520*a*, 520*b* (i.e., without dynamic cord members 525*a*, 525*b*), as illustrated in FIG. 26, the portable lower limb therapy device 500 is able to function as the portable lower limb therapy device built in accordance with the dual cord back handle embodiment does. In this regard, the portable lower limb therapy device 500 may not only add new capabilities, it may also incorporate the advantageous features of the static embodiments.

When the portable lower limb therapy device 500 is used with dynamic cord members 525*a*, 525*b*, however, it is contemplated that a user may simply hold handle members 523*a*, 523*b* in place and utilize the resistance being provided by the dynamic cord members 525*a*, 525*b* when performing exercises. In this regard, a user may keep their hands, and the handle members 523*a*, 523*b* and handle extension members 524*a*, 524*b*, still and allow the resistance in the dynamic cord members 525*a*, 525*b* to supply resistance.

Moreover, whether dynamic cord members 525*a*, 525*b* are in use or not, it is contemplated that a user having their foot positioned in the lower limb therapy device 500 may exert mechanical force on the lower limb therapy device 500 with their upper body (as passive motion) by grabbing either the handle members 523*a*, 523*b* or the cross member 522. In this regard, the lower limb therapy device 500 enables pulling, pushing and lifting actions.

Figure 29:
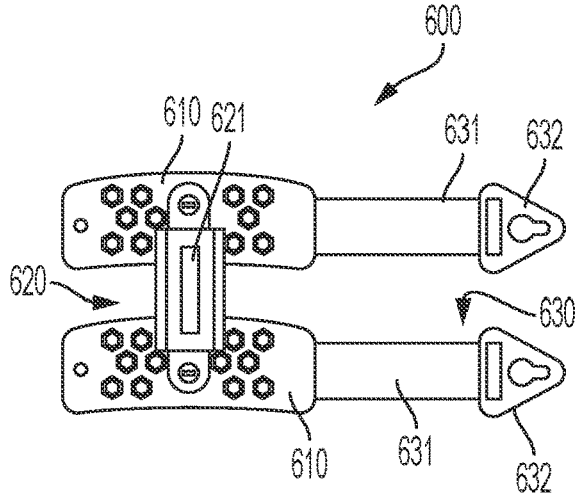
FIG. 29 is a top plan view of a wearable anchor for a portable lower limb therapy device built in accordance with a double strap embodiment of the present invention.
Figure 30:
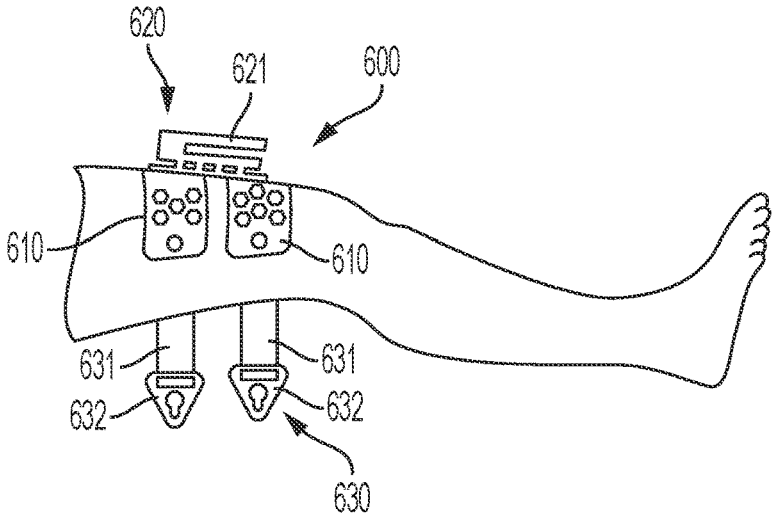
FIG. 30 is a side elevational view of a wearable anchor for a portable lower limb therapy device built in accordance with a double strap embodiment of the present invention, shown in place on a patient's leg with a securing strap disconnected.
Figure 31:
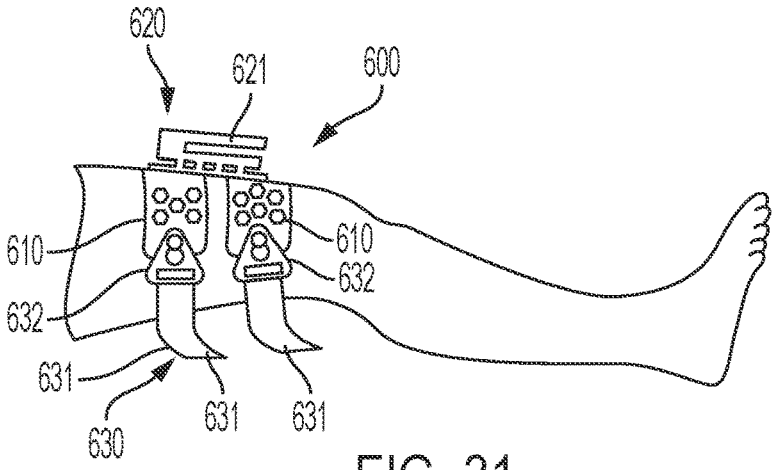
FIG. 31 is a side elevational view of a wearable anchor for a portable lower limb therapy device built in accordance with a double strap embodiment of the present invention, shown in place on a patient's leg with a securing strap connected.

Referring now to FIGS. 29, 30 and 31, a wearable anchor 600 for a therapy device is shown having support members 610, a locking component 620, and securing straps 630. The support members 610 may be defined by a pair of non-slip pads which are sized to be placed on and contour to the thigh of a user and thereby configured to be placed against a user's body. The support members 610 may be constructed out of a semi rigid material that has a non-slip surface. It is contemplated, however, that the support members 610 may alternatively include a hard plastic top layer and a padded bottom layer such that the portion of the support members 610 that is pressed against a user's thigh is cushioned.

Coupled with the surface of the support members 610 that is opposite the surface which is to be pressed against a user's thigh is a locking component 620. The locking component 620 may be defined by a single slot member 621 which is attached to both support members 610 or a pair of slot members 621 which are attached to both support members 610. The slot members 621 extend up vertically from the top surface of the support members 610, extending orthogonally across the support members 610. In such a configuration, the locking component 620 operates as a coupling mechanism for the two support members 610, joining them together as a single wearable anchor 600. And as the support members 610 are structured to lay on top of and across a user's thigh the slot members 621 are oriented in a manner in which they extend substantially perpendicular to the length of a user's thigh.

Each of the slot members 621 may include a tapered or untampered slot in which the cord members of any embodiment of a portable lower limb therapy device disclosed herein may be wrapped around and secured in. In this regard, the slot members 621 with their slots configure the locking component 620 to receive and selectively secure a cord. The slots may be oriented in the slot members 621 such that they extend into the body of the slot member 621 and are substantially parallel to the length of a user's thigh when the wearable anchor 600 is in place on the user.

The securing straps 630 may each include an elongated band 631 that extends from one of the ends of one of the support members 610 and an attachment mechanism 632 disposed at the end of the elongated band 631. Adjacent to the end of the support member 610 that is opposite the end to which the elongated band attached may be a raised attachment nub 611. The attachment mechanism 632 may include an aperture in its body to allow it to attach to the attachment nub 611 on one of the support members 610. Through this design, the attachment mechanism 632 at the end of a given elongated band 631 is configured to attach to the support member 610 to which the given elongated band 631 extends from. In this regard, by placing the support members 610 on a user's thigh, looping the securing straps 630 around the user's thigh, and attaching the attachment mechanisms 632 to the respective support members 610, the support members 610 can be releasably secured to the thigh of a user.

The securing straps 630 may additionally include a tightening mechanism, with the elongated bands 631 being looped through the attachment mechanism 632, using the attachment mechanism as a buckle so as to allow the length of the elongated bands 631 to be selectively increased and decreased. In an embodiment, the elongated bands 631 may include corresponding portions of a hook and loop fastener integral therewith which allow them to be set in place at a desired length.

In use, the dual strap embodiment of the wearable anchor 600 may be deployed in substantially the same manner as the single strap embodiment of the wearable anchor.

During the healing process after injury or surgery the connective tissue around the joint may shorten or start to form scar tissue which will restrict the knee's range of motion. This will delay patient's rehab efforts and may lead to prolonged complications and loss of quality of life if patient is unable to regain full flexion and or extension of their knee. Static-progressive stretching techniques have been medically proven to breakdown scar tissue and restore full range of motion. When patient engages in static-progressive therapy the scar tissue breaks down and connective tissue is as able to properly stretch out allowing for full range of motion.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable lower limb therapy device, comprising:

a support base having an exterior surface and an interior surface, wherein the interior surface is configured to receive a foot of a user and the exterior surface includes at least one smooth surface which enables the support base to slide on a discrete surface that is also smooth;

wherein the support base includes a proximal edge and a distal edge;

a closed force transfer system integral with the support base, wherein the closed force transfer system includes at least one connector member having a back end and at least one discrete cord member having a front end and an opposing handle end;

wherein the at least one connector member is integral with the support base at both a location adjacent to the proximal edge and a location adjacent to the distal edge, with the back end positioned closer to the location adjacent to the distal edge;

wherein the front end of the at least one discrete cord member is selectively coupled with the back end of the at least one connector member; and wherein the closed force transfer system is operative to allow force exerted through the at least one discrete cord member to be transferred to the support base.

2. The portable lower limb therapy device of claim 1, additionally comprising:

a wearable anchor configured to be secured to a body of a user and having at least one support member and at least one locking component, wherein said at least one support member includes a top surface and a bottom surface and is configured to be placed against the body of the user with the bottom surface contacting the body of the user; and wherein said locking component is configured to receive and selectively secure the at least one discrete cord member.

3. The portable lower limb therapy device of claim 2, wherein the locking component is defined by a pair of slot members that each extend up vertically from the top surface.

4. The portable lower limb therapy device of claim 1, wherein said interior surface comprises a resilient pad member.

5. The portable lower limb therapy device of claim 1, wherein the at least one connector member has a higher modulus of elasticity than the at least one discrete cord member.

6. The portable lower limb therapy device of claim 1, additionally comprising at least one handle member attached to the handle end of the at least one discrete cord member.

7. A portable lower limb therapy device, comprising:

a support base having an exterior surface and an interior surface, wherein the interior surface is configured to receive a foot of a user and the exterior surface includes at least one smooth surface which enables the support base to slide on a discrete surface that is also smooth;

wherein the support base includes a proximal edge, a distal edge as well as a right side and a left side;

a closed force transfer system integral with the support base, wherein the closed force transfer system includes a plurality of connector members, each having a back end, and a plurality of discrete cord members, each having a front end and an opposing handle end;

wherein each of the plurality of connector members is integral with the support base at both a location adjacent to the proximal edge and a location adjacent to the distal edge, with the back end positioned closer to the location adjacent to the distal edge;

wherein the front end of each of the plurality of discrete cord members is selectively coupled with the back end of one of the plurality of connector members; and wherein the closed force transfer system is operative to allow force exerted through the plurality of discrete cord members to be transferred to the support base.

8. The portable lower limb therapy device of claim 7, wherein a first connector member among the plurality of connector members is positioned adjacent to the right side of the support base and a second connector member among the plurality of connector members is positioned adjacent to the left side of the support base.

9. The portable lower limb therapy device of claim 8, wherein the closed force transfer system includes a cross member positioned above the support base at a cross location between the proximal edge and the distal edge.

10. The portable lower limb therapy device of claim 9, wherein the cross member is integral with both the first connector member and the second connector member.

11. The portable lower limb therapy device of claim 7, additionally comprising:

a wearable anchor configured to be secured to a body of a user and having at least one support member and at least one locking component, wherein said at least one support member includes a top surface and a bottom surface and is configured to be placed against the body of the user with the bottom surface contacting the body of the user; and wherein said locking component is configured to receive and selectively secure the at least one discrete cord member.

12. The portable lower limb therapy device of claim 11, wherein the locking component is defined by a pair of slot members that each extend up vertically from the top surface.

13. The portable lower limb therapy device of claim 7, wherein said interior surface comprises a resilient pad member.

14. The portable lower limb therapy device of claim 7, wherein the plurality of connector members have a higher modulus of elasticity than the plurality of discrete cord members.

15. The portable lower limb therapy device of claim 7, additionally comprising a handle member attached to the handle end of each of the plurality of discrete cord members.

16. A portable lower limb therapy device, comprising:

a support base having an exterior surface and an interior surface, wherein the interior surface is configured to receive a foot of a user and the exterior surface includes at least one smooth surface which enables the support base to slide on a discrete surface that is also smooth;

wherein the support base includes a proximal edge, a distal edge as well as a right side and a left side;

a closed force transfer system integral with the support base, wherein the closed force transfer system includes a plurality of connector members, each having a back end, and a plurality of discrete cord members, each having a front end and an opposing handle end, and a cross member positioned above the support base at a cross location between the proximal edge and the distal edge;

wherein each of the plurality of connector members is integral with the support base at both a location adjacent to the proximal edge and a location adjacent to the distal edge, with the back end positioned closer to the location adjacent to the distal edge;

wherein the front end of each of the plurality of discrete cord members is selectively coupled with the back end of one of the plurality of connector members;

wherein the closed force transfer system is operative to allow force exerted through the plurality of discrete cord members to be transferred to the support base;

wherein a first connector member among the plurality of connector members is positioned adjacent to the right side of the support base and a second connector member among the plurality of connector members is positioned adjacent to the left side of the support base; and wherein the plurality of connector members have a higher modulus of elasticity that the plurality of discrete cord members.

17. The portable lower limb therapy device of claim 16, wherein the cross member is integral with both the first connector member and the second connector member.

18. The portable lower limb therapy device of claim 16, additionally comprising:

a wearable anchor configured to be secured to a body of a user and having at least one support member and at least one locking component, wherein said at least one support member includes a top surface and a bottom surface and is configured to be placed against the body of the user with the bottom surface contacting the body of the user; and wherein said locking component is configured to receive and selectively secure the at least one discrete cord member.

19. The portable lower limb therapy device of claim 18, wherein the locking component is defined by a pair of slot members that each extend up vertically from the top surface.

20. The portable lower limb therapy device of claim 16, additionally comprising a handle member attached to the handle end of each of the plurality of discrete cord members.

* * * * *